US006473002B1

(12) United States Patent
Hutchison

(10) Patent No.: US 6,473,002 B1
(45) Date of Patent: Oct. 29, 2002

(54) SPLIT-PHASE PED HEAD SIGNAL

(75) Inventor: Michael C. Hutchison, Plano, TX (US)

(73) Assignee: Power Signal Technologies, Inc., Plano, TX (US)

( * ) Notice: Subject to any disclaimer, the term of this patent is extended or adjusted under 35 U.S.C. 154(b) by 16 days.

(21) Appl. No.: 09/679,787

(22) Filed: Oct. 5, 2000

(51) Int. Cl.[7] ..... G08G 1/095

(52) U.S. Cl. ..... 340/944; 340/907; 340/815.4; 340/815.45; 340/815.53; 40/541; 40/557; 40/553; 362/84; 362/555; 362/559

(58) Field of Search ..... 340/944, 907, 340/917, 815.4, 815.45, 815.49, 815.5, 815.52, 815.53, 815.55, 815.73, 815.76; 40/541, 557, 545, 553; 362/84, 555, 559, 549

(56) References Cited

U.S. PATENT DOCUMENTS 5,132,683 A * 7/1992 Gould et al. ..... 340/944
6,054,932 A * 4/2000 Gartner et al. ..... 340/815.65
RE36,930 E * 10/2000 Houten et al. ..... 340/944
6,160,495 A * 12/2000 Demink et al. ..... 340/944
6,323,781 B1 * 11/2001 Hutchison ..... 340/815.4

* cited by examiner

*Primary Examiner*—Daniel J. Wu
*Assistant Examiner*—Toan Pham
(74) *Attorney, Agent, or Firm*—Jackson Walker LLP

(57) ABSTRACT

A split-phase pedestrian head traffic signal having directional light beams and a variable beamwidth. The pedestrian heads are selectively controlled such that half-way through a control cycle, a pedestrian half-way across the street may see a "walk" signal, while a pedestrian still at the far side of the street will actually see a "stop hand" signal. A pair of pedestrian heads each having a split-phase facilitate the beam steering such that the appropriate walk or stop hand signal are viewed by the pedestrian at the appropriate location. An area array of LEDs in combination with a Fresnel lens is selectively controlled such that light generated from the respective head can be directed toward different positions of the street for informing pedestrians at different locations attempting to cross the street.

20 Claims, 21 Drawing Sheets

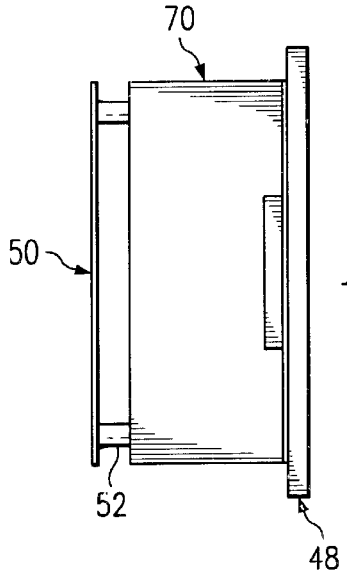
FIG. 7
FIG. 8
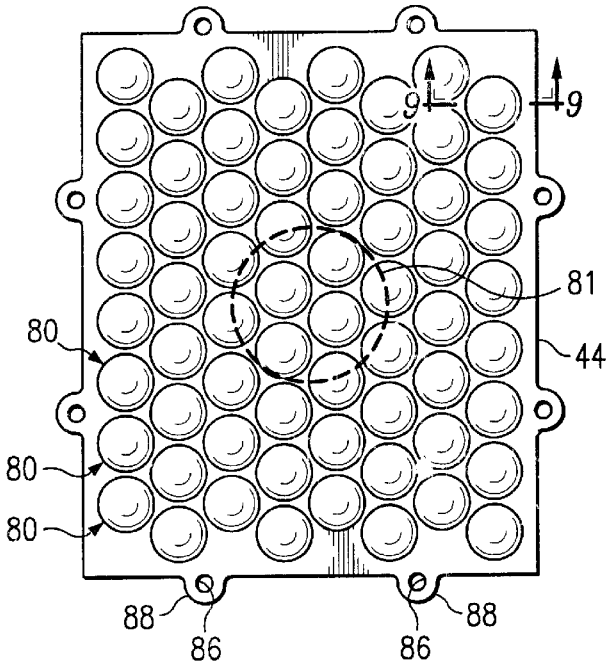
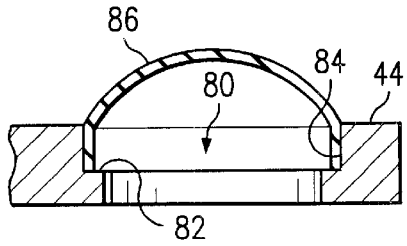
FIG. 9

FIG. 10
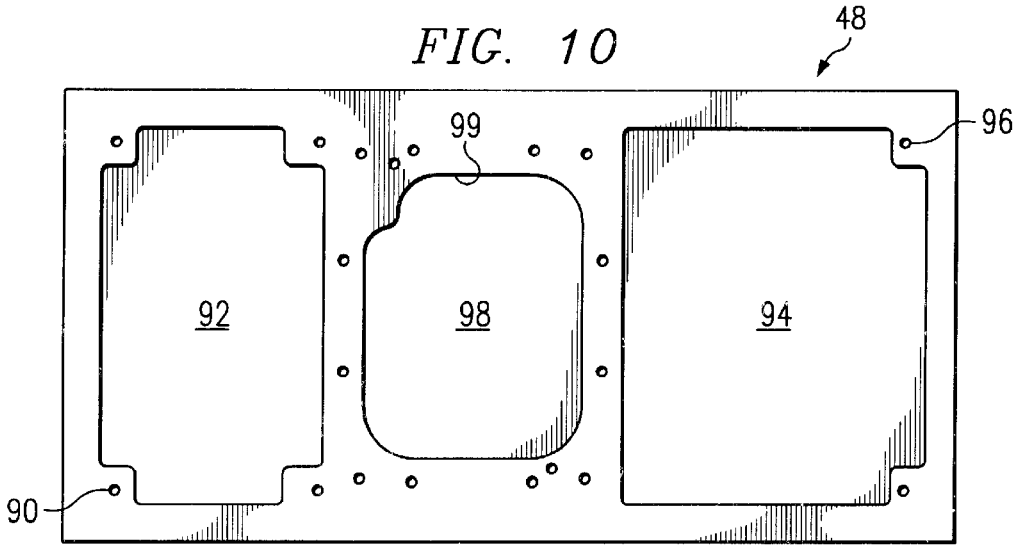
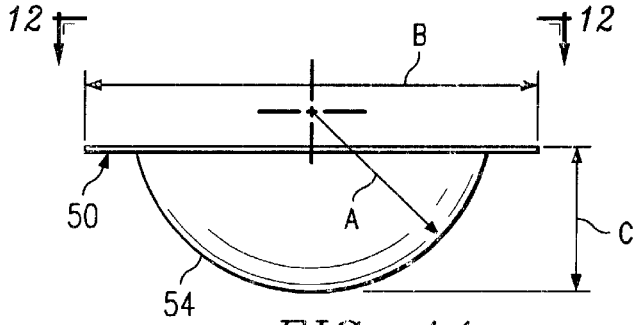
FIG. 11
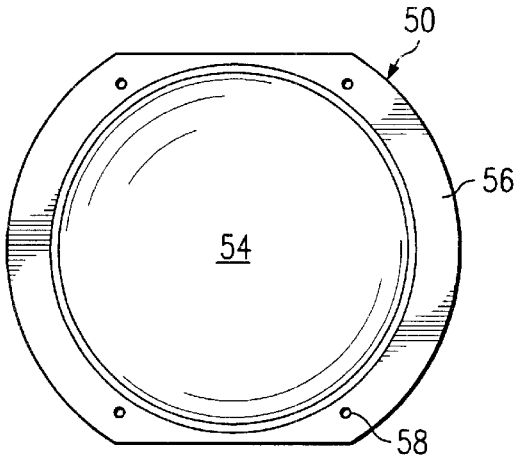
FIG. 12
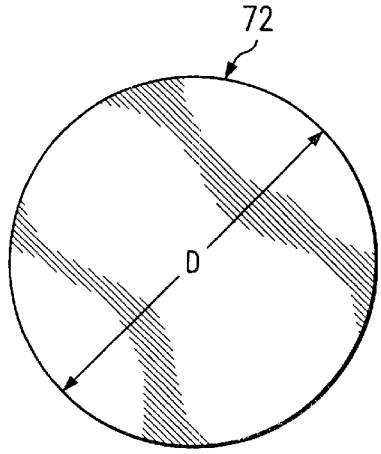
FIG. 13

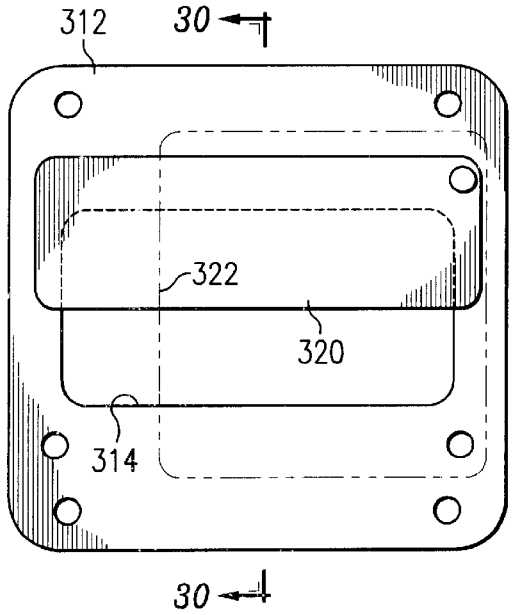
FIG. 29
FIG. 30
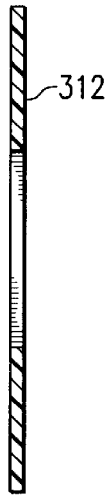
FIG. 31
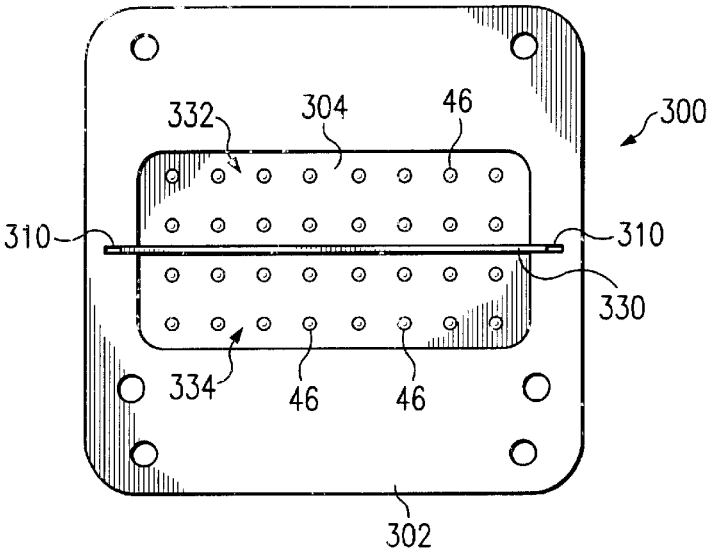
FIG. 32
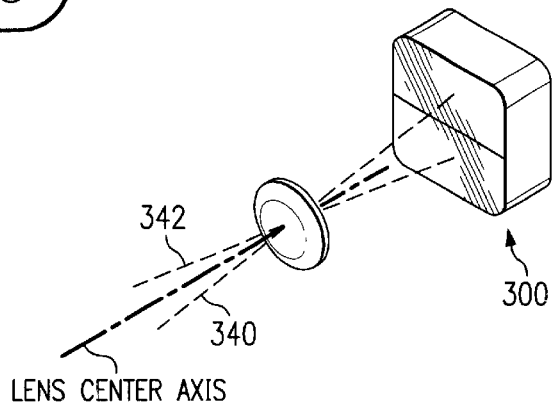

SPLIT-PHASE PED HEAD SIGNAL

FIELD OF THE INVENTION

The present invention is generally related to traffic signal lights including those incorporating solid state light sources, and more particularly to pedestrian signals known as PED heads.

BACKGROUND OF THE INVENTION

Traffic signal lights have been around for years and are used to efficiently control traffic through intersections. While traffic signals have been around for years, improvements continue to be made in the areas of traffic signal light control algorithms, traffic volume detection, and emergency vehicle detection.

Pedestrian head signals have also been around for years and help inform pedestrians whether it is safe to cross a street, and also if it is safe to continue crossing a street. Unfortunately, this signalling to a pedestrian can be confusing since it is often unknown how much time remains before an associated traffic light changes states. A blinking "don't walk" or "stop hand" signal confuses a pedestrian since it may be unknown the time to cycle change. A pedestrian halfway across a street may not know if there is still time to continue crossing.

There is desired an improved pedestrian head signal capable of discretely signaling pedestrian at a far side, and half-way across a street whether it is safe to cross or continue crossing, respectively.

SUMMARY OF THE INVENTION

The present invention achieves technical advantages as split phase pedestrian head signal adapted to inform a pedestrian at a far side of a street and at the middle of a street whether it is safe, from the respective position, to cross or continue crossing the associated street.

The solid state light apparatus has a first array of LEDs having an upper portion and a lower portion, and a first lens disposed over the first LED array. A control circuit selectively controls each of the first LED array portions, whereby the upper portion in combination with the lens generates a first light beam in a first direction, and the LED array lower portion in combination with the lens generates a second light beam in a second direction being different than the first direction. Each of the light beams has a beamwidth of about 10°, with the first light beam being directed toward and viewable by the pedestrian at the far side of the associated street, and the second light beam being directed to and viewable by a pedestrian at the middle of the street. A second similar solid state light apparatus is provided having a similar array of LEDs having an upper portion and a lower portion, and a second lens disposed over the second LED array. The control circuit selectively controls the upper and lower LED array portions to generate a third and fourth light beam in a third and fourth direction, respectively. The third light beam is directed toward the pedestrian at the far side of the street, and the fourth light beam is directed at a pedestrian half-way across the street. The first light apparatus first and second light beams illuminate a "walk" symbol, and the second solid state light apparatus third and fourth light beams illuminate a "don't walk" symbol.

According to the method of the present invention, in a first state of operation, the "walk" symbol is illuminated by both the first and second light beam and is ascertainable by a pedestrian both across the street and half-way across the street. In a second state of operation, the second light beam is generated such that a walk symbol is viewable by a pedestrian half-way across the street, but wherein the third light beam is generated to illuminate the "don't walk" symbol which is viewable by a pedestrian across the street. In the third state of operation, only the third and fourth light beams are generated such that the "don't walk" symbol is ascertainable by a pedestrian both across the street and half-way across the street.

The split-phase pedestrian head is advantageous in that it provides a better indication to a pedestrian whether or not it is safe to start walking across the street, and whether or not a pedestrian half-way across the street should continue to cross the street or remain at the center of the street until the next light cycle.

BRIEF DESCRIPTION OF THE DRAWINGS

FIG. 7 is a side view of the electronics assembly of FIG. 4;

FIG. 8 is a top view of the lens holder adapted to hold lenses for the array of LEDs;

FIG. 9 is a sectional view taken alone lines 9—9 in FIG. 8 illustrating a shoulder and side wall adapted to securely receive a respective lens for a LED mounted thereunder;

FIG. 10 is a top view of the heatsink comprised of a thermally conductive material and adapted to securingly receive each LED, the LED holder of FIG. 8, as well as the other componentry;

FIG. 11 is a side view of the light diffuser depicting its radius of curvature;

FIG. 12 is a top view of the light diffuser of FIG. 11 illustrating the mounting flanges thereof;

FIG. 13 is a top view of a Fresnel lens as shown in FIG. 3;

FIG. 29 is a top view of the light diffuser shown in FIG. 28;

FIG. 30 is a side sectional view taken along line 30—30 in FIG. 29;

FIG. 31 is a top view of a single cavity split-phase light source adapted for use at a pedestrian head; and FIG. 32 depicts the operation of a pair of split-phase pedestrian head signals controlled to inform pedestrians at different locations of an intersection whether it is safe to walk.

DETAILED DESCRIPTION OF PREFERRED EMBODIMENTS

Figure 1B:
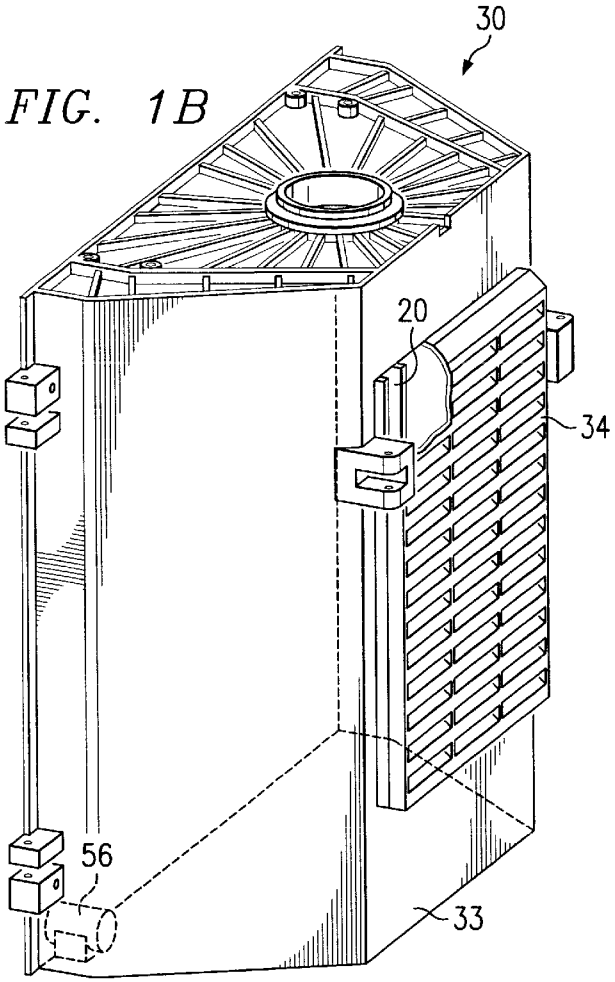
FIG. 1A and FIG. 1B is a front perspective view and rear perspective view, respectively, of a solid state lightapparatus according to a first preferred embodiment of the present invention including an optical alignment eye piece.
Figure 1A:
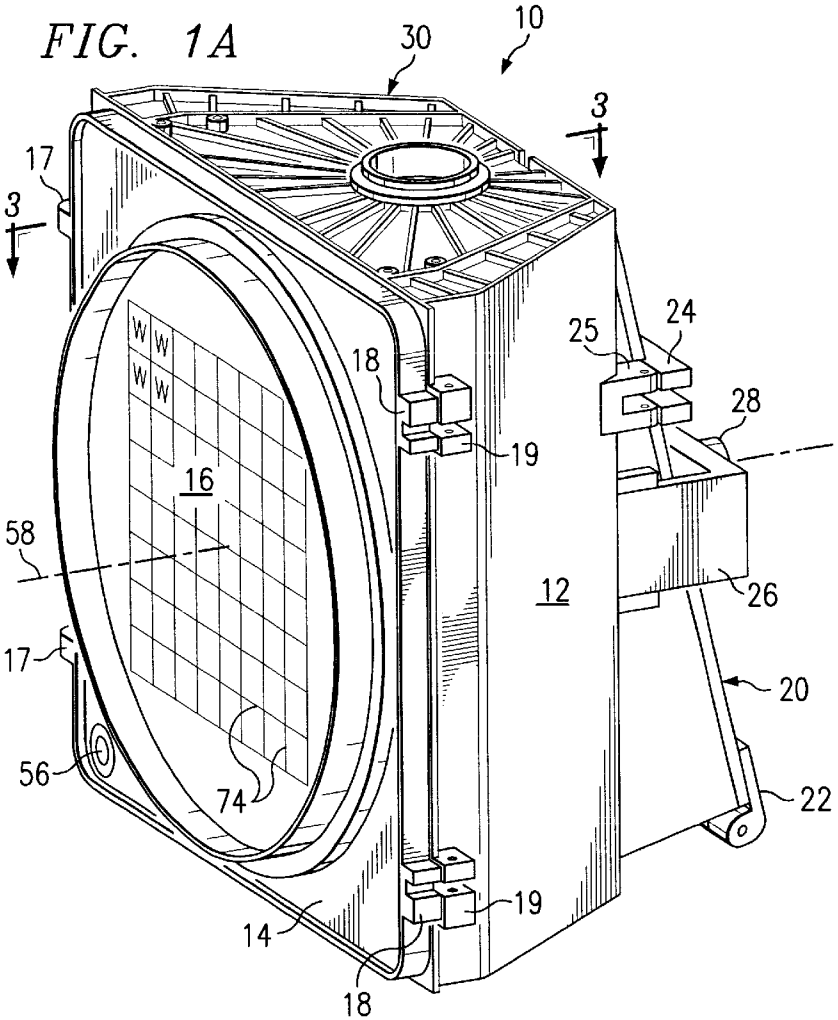

Referring now to FIG. 1A, there is illustrated generally at 10 a front perspective view of a solid state lamp apparatus according to a first preferred embodiment of the present invention. Light apparatus 10 is seen to comprise a trapezoidal shaped housing 12, preferably comprised of plastic formed by a plastic molding injection techniques, and having adapted to the front thereof a pivoting lid 14. Lid 14 is seen to have a window 16, as will be discussed shortly, permitting light generated from within housing 12 to be emitted as a light beam therethrough. Lid 14 is selectively and securable attached to housing 12 via a hinge assemble 17 and secured via latch 18 which is juxtaposed with respect to a housing latch 19, as shown.

Figure 2B:
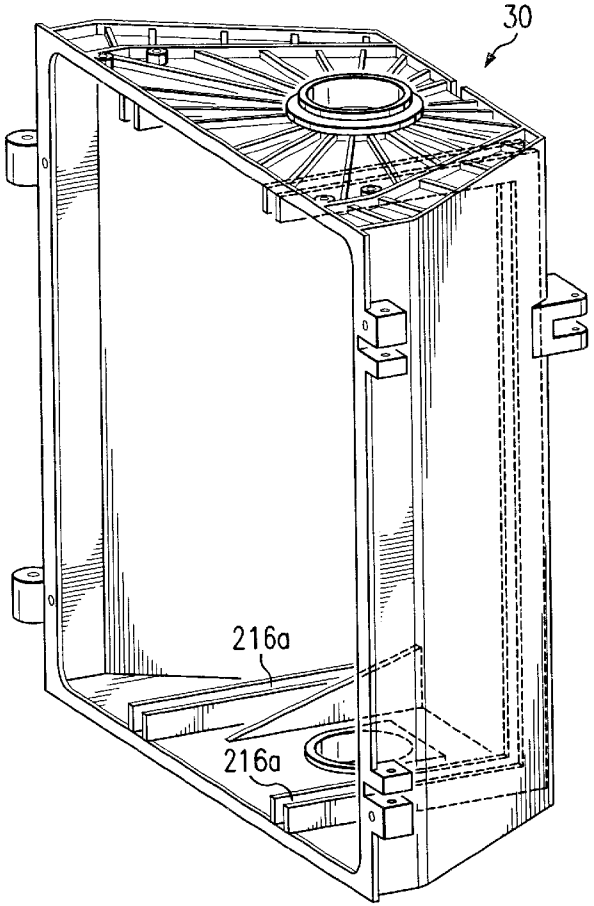
FIG. 2A and FIG. 2B is a front perspective view and a rear perspective view, respectively, of a second preferred embodiment having a solar louvered external air cooled heatsink.

Referring now to FIG. 1B and FIG. 2B, there is illustrated a second preferred embodiment of the present invention at 32 similar to apparatus 10, whereby a housing 33 includes a solar louver 34 as shown in FIG. 2B. The solar louver 34 is secured to housing 33 and disposed over a external heatsink 20 which shields the external heatsink 20 from solar radiation while permitting outside airflow across the heatsink 20 and under the shield 34, thereby significantly improving cooling efficiency as will be discussed more shortly.

Figure 2A:
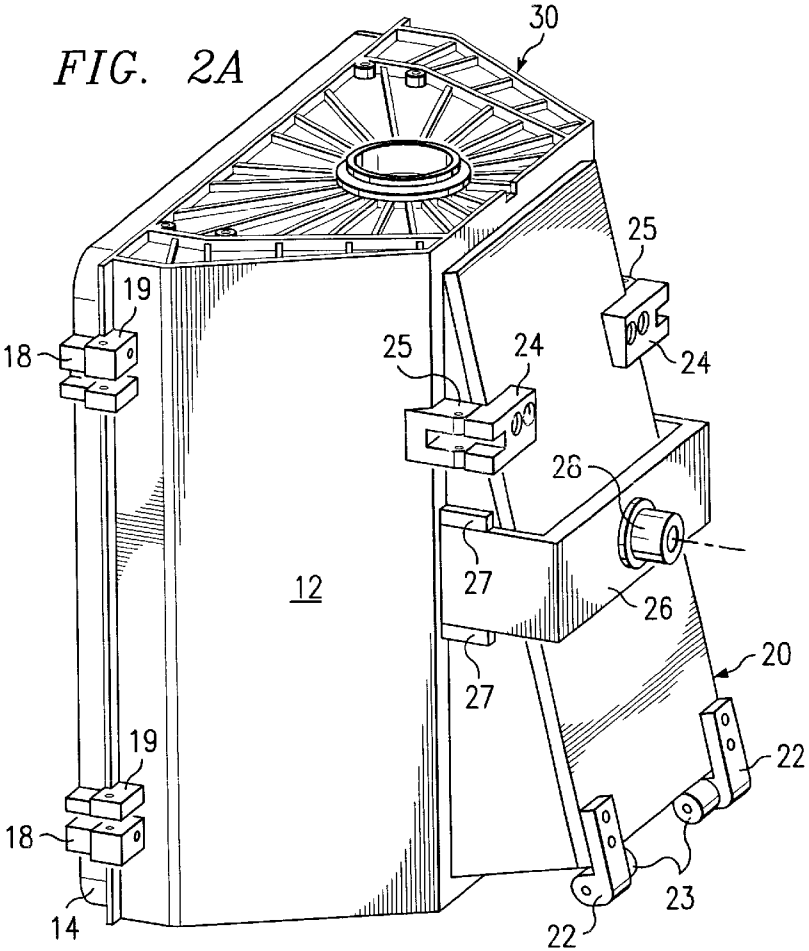

Referring to FIG. 2A, there is shown light apparatus 10 of FIG. 1A having a rear removable back member 20 comprised of thermally conductive material and forming a heatsink for radiating heat generated by the internal solid state light source, to be discussed shortly. Heatsink 20 is seen to have secured thereto a pair hinges 22 which are rotatably coupled to respective hinge members 23 which are securely attached and integral to the bottom of the housing 12, as shown. Heatsink 20 is further seen to include a pair of opposing upper latches 24 selectively securable to respective opposing latches 25 forming an integral portion of and secured to housing 12. By selectively disconnecting latches 24 from respective latches 25, the entire rear heatsink 20 may be pivoted about members 23 to access the internal portion of housing 12, as well as the light assembly secured to the front surface of heatsink 20, as will be discussed shortly in regards to FIG. 3.

Figure 3:
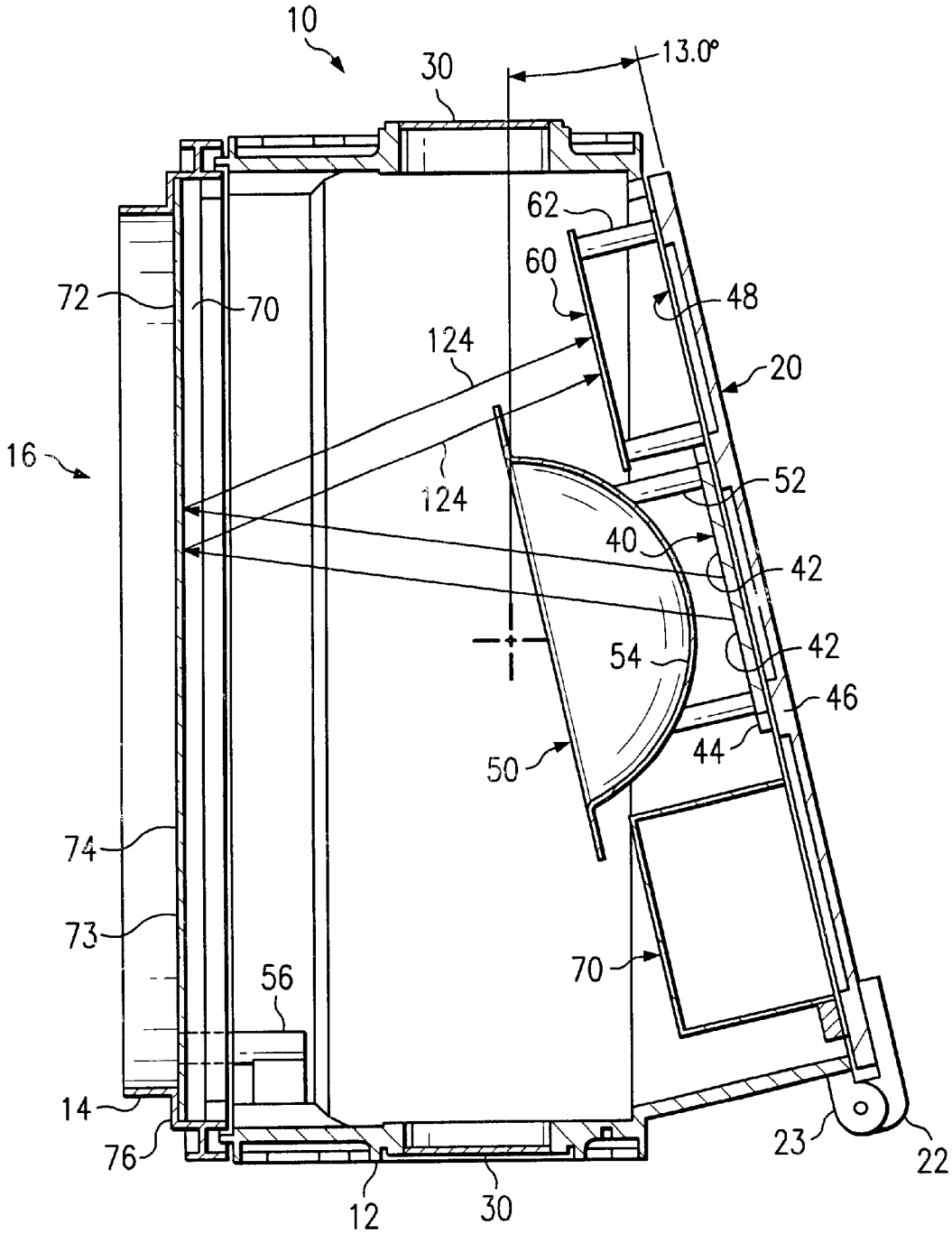
FIG. 3 is a side sectional view of the apparatus shown in FIG. 1 illustrating the electronic and optical assembly and lens system comprising an array of LEDs directly mounted to a heatsink, directing light through a diffuser and through a Fresnel lens.

Still referring to FIG. 2A, light apparatus 10 is further seen to include a rear eye piece 26 including a U-shaped bracket extending about heatsink 20 and secured to housing 12 by slidably locking into a pair of respective locking members 29 securely affixed to respective sidewalls of housing 12. Eye piece 26 is also seen to have a cylindrical optical sight member 28 formed at a central portion of, and extending rearward from, housing 12 to permit a user to optically view through apparatus 10 via optically aligned window 16 to determine the direction a light beam, and each LED, is directed, as will be described in more detail with reference to FIG. 14 and FIG. 15. Also shown is housing 12 having an upper opening 30 with a serrated collar centrally located within the top portion of housing 12, and opposing opening 30 at the lower end thereof, as shown in FIG. 3. Openings 30 facilitate securing apparatus 10 to a pair of vertical posts allowing rotation laterally thereabout.

Referring now to FIG. 3, there is shown a detailed cross sectional view taken along line 3—3 in FIG. 1, illustrating a solid state light assembly 40 secured to rear heatsink 20 in such an arrangement as to facilitate the transfer of heat generated by light assembly 40 to heatsink 20 for the dissipation of heat to the ambient via heatsink 20.

Solid state light assembly 40 is seen to comprise an array of light emitting diodes (LEDs) 42 aligned in a matrix, preferably comprising an 8×8 array of LEDs each capable of generating a light output of 1–3 lumens. However, limitation to the number of LEDs or the light output of each is not to be inferred. Each LED 42 is directly bonded to heatsink 20 within a respective light reflector comprising a recess defined therein. Each LED 42 is hermetically sealed by a glass material sealingly diffused at a low temperature over the LED die 42 and the wire bond thereto, such as 8000 Angstroms of, $SiO_2$ or $Si_3N_4$ material diffused using a semiconductor process. The technical advantages of this glass to metal hermetic seal over plastic/epoxy seals is significantly a longer LED life due to protecting the LED die from oxygen, humidity and other contaminants. If desired, for more light output, multiple LED dies 42 can be disposed in one reflector recess. Each LED 42 is directly secured to, and in thermal contact arrangement with, heatsink 20, whereby each LED is able to thermally dissipate heat via the bottom surface of the LED. Interfaced between the planar rear surface of each LED 42 is a thin layer of heat conductive material 46, such as a thin layer of epoxy or other suitable heat conductive material insuring that the entire rear surface of each LED 42 is in good thermal contact with rear heatsink 20 to efficiently thermally dissipate the heat generated by the LEDs. Each LED connected electrically in parallel has its cathode electrically coupled to the heatsink 20, and its Anode coupled to drive circuitry disposed on daughterboard 60. Alternatively, if each LED is electrically connected in series, the heatsink 20 preferably is comprised of an electrically non-conductive material such as ceramic.

Further shown in FIG. 3 is a main circuit board 48 secured to the front surface of heatsink 20, and having a central opening for allowing LED to pass generated light therethrough. LED holder 44 mates to the main circuit board 48 above and around the LED's 42, and supports a lens 86 above each LED. Also shown is a light diffuser 50 secured above the LEDs 42 by a plurality of standoffs 52, and having a rear curved surface 54 spaced from and disposed above the LED solid state light source 40, as shown. Each lens 86 (FIG. 9) is adapted to ensure each LED 42 generates light which impinges the rear surface 54 having the same surface area. Specifically, the lenses 86 at the center of the LED array have smaller radius of curvature than the lenses 86 covering the peripheral LEDs 42. The diffusing lenses 46 ensure each LED illuminates the same surface area of light diffuser 50, thereby providing a homogeneous (uniform) light beam of constant intensity.

A daughter circuit board 60 is secured to one end of heatsink 20 and main circuit board 48 by a plurality of standoffs 62, as shown. At the other end thereof is a power supply 70 secured to the main circuit board 48 and adapted to provide the required drive current and drive voltage to the LEDs 42 comprising solid state light source 40, as well as electronic circuitry disposed on daughterboard 60, as will be discussed shortly in regards to the schematic diagram shown in FIG. 16. Light diffuser 50 uniformly diffuses light generated from LEDs 42 of solid state light source 40 to produce a homogeneous light beam directed toward window 16.

Window 16 is seen to comprise a lens 70, and a Fresnel lens 72 in direct contact with lens 70 and interposed between lens 70 and the interior of housing 12 and facing light diffuser 50 and solid state light source 40. Lid 14 is seen to have a collar defining a shoulder 76 securely engaging and holding both of the round lens 70 and 72, as shown, and transparent sheet 73 having defined thereon grid 74 as will be discussed further shortly. One of the lenses 70 or 72 are colored to produce a desired color used to control traffic including green, yellow, red, white and orange.

It has been found that with the external heatsink being exposed to the outside air the outside heatsink 20 cools the LED die temperature up to 50° C. over a device not having a external heatsink. This is especially advantageous when the sun setting to the west late in the afternoon such as at an elevation of 10° or less, when the solar radiation directed in to the lenses and LEDs significantly increasing the operating temperature of the LED die for westerly facing signals. The external heatsink 20 prevents extreme internal operating air and die temperatures and prevents thermal runaway of the electronics therein.

Figure 4:
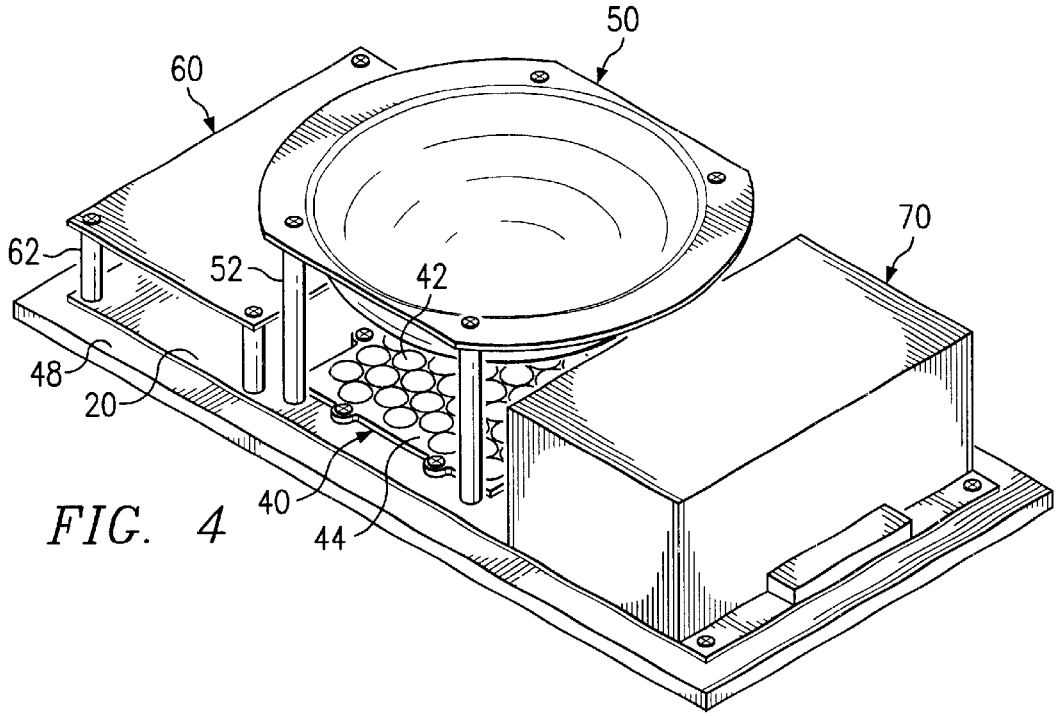
FIG. 4 is a perspective view of the electronic and optical assembly comprising the LED array, lense holder, light diffuser, power supply, main motherboard and daughterboard.

Referring now to FIG. 4, there is shown the electronic and optic assembly comprising of solid state light source 40, light diffuser 50, main circuit board 48, daughter board 60, and power supply 70. As illustrated, the electronic circuitry on daughter board 60 is elevated above the main board 48, whereby standoffs 62 are comprised of thermally nonconductive material.

Figure 5:
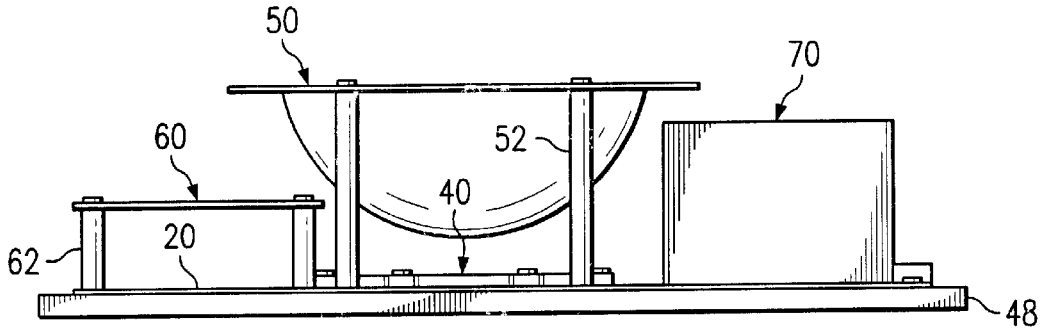
FIG. 5 is a side view of the assembly of FIG. 4 illustrating the array of LEDs being directly mounted to the heatsink, below respective lenses and disposed beneath a light diffuser, the heatsink for terminally dissipating generated heat.

Referring to FIG. 5, there is shown a side view of the assembly of FIG. 4 illustrating the concave light diffuser 50 being axially centered and having a convex bottom surface disposed above the solid state LED array 40. Diffuser 50, in combination with the varying diameter lenses 86, facilitates light generated from the area array of LEDs 42 to be uniformly disbursed and have uniform intensity and directed upwardly upon and across the convex bottom surface of the light diffuser 50 such that a homogenous light beam is generated toward the lens 70 and 72, as shown in FIG. 3. The lenses 86 proximate the center of the area array have a smaller radius of curvature than the peripheral lenses 86 which tend to be flatter. this lens arrangement provides that the LEDs 42 uniformly illuminate the curved diffuser 50, even at the upwardly curved edges thereof. the outer lenses 86, tend to columnate the light of the peripheral LEDs more than the central lenses 86. Each LED illuminates an equal area of the diffuser.

Figure 6:
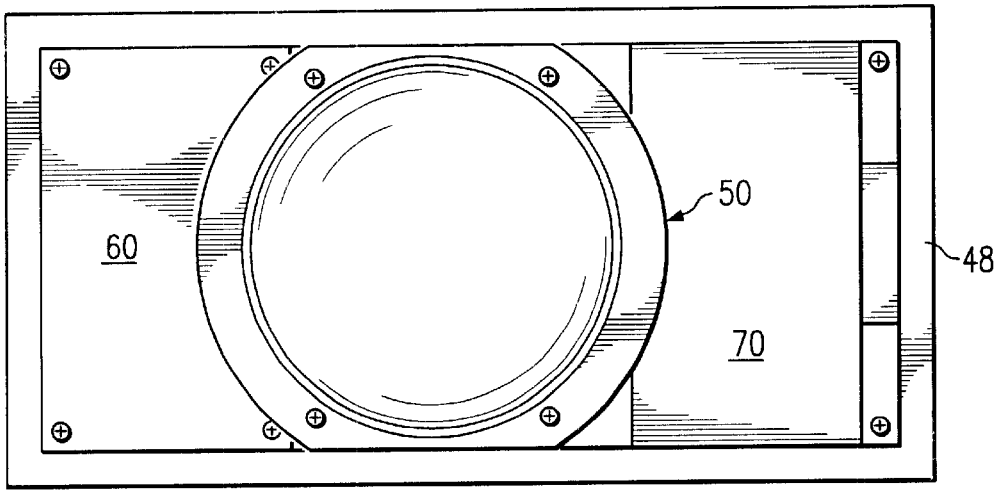
FIG. 6 is a top view of the electronics assembly of FIG. 4.

Referring now to FIG. 6, there is shown a top view of the assembly shown in FIG. 4, whereby FIG. 7 illustrates a side view of the same.

Referring now to FIG. 8, there is shown a top view of the lens holder 44 comprising a plurality of openings 80 each adapted to receive one of the LED lenses 86 hermetically sealed to and bonded thereover. Advantageously, the glass to metal hermetic seal has been found in this solid state light application to provide excellent thermal conductivity and hermetic sealing characteristics. Each opening 80 is shown to be defined in a tight pack arrangement about the plurality of LEDs 42. As previously mentioned, the lenses 86 at the center of the array, shown at 81, have a smaller curvature diameter than the lenses 86 over the perimeter LEDs 42 to increase light dispersion and ensure uniform light intensity impinging diffuser 50.

Referring to FIG. 9, there is shown a cross section taken alone line 9—9 in FIG. 8 illustrating each opening 80 having an annular shoulder 82 and a lateral sidewall 84 defined so that each cylindrical lens 86 is securely disposed within opening 80 above a respective LED 42. Each LED 42 is preferably mounted to heatsink 20 using a thermally conductive adhesive material such as epoxy to ensure there is no air gaps between the LED 42 and the heatsink 20. The present invention derives technical advantages by facilitating the efficient transfer of heat from LED 42 to the heatsink 20.

Referring now to FIG. 10, there is shown a top view of the main circuit board 48 having a plurality of openings 90 facilitating the attachment of standoffs 62 securing the daughter board above an end region 92. The power supply 48 is adapted to be secured above region 94 and secured via fasteners disposed through respective openings 96 at each corner thereof. Center region 98 is adapted to receive and have secured thereagainst in a thermal conductive relationship the LED holder 42 with the thermally conductive material 46 being disposed thereupon. The thermally conductive material preferably comprises of epoxy, having dimensions of, for instance, 0.05 inches. A large opening 99 facilitates the attachment of LED's 42 to the heatsink 20, and such that light from the LEDs 42 is directed to the light diffuser 50.

Referring now to FIG. 11, there is shown a side elevational view of diffuser 50 having a lower concave surface 54, preferably having a radius A of about 2.4 inches, with the overall diameter B of the diffuser including a flange 55 being about 6 inches. The depth of the rear surface 52 is about 1.85 inches as shown as dimension C.

Referring to FIG. 12, there is shown a top view of the diffuser 50 including the flange 56 and a plurality of openings 58 in the flange 56 for facilitating the attachment of standoffs 52 to and between diffuser 50 and the heatsink 20, shown in FIG. 4.

Referring now to FIG. 13 there is shown the Fresnel lens 72, preferably having a diameter D of about 12.2 inches. However, limitation to this dimension is not to be inferred, but rather, is shown for purposes of the preferred embodiment of the present invention. The Fresnel lens 72 has a predetermined thickness, preferably in the range of about 1/16 inches. This lens is typically fabricated by being cut from a commercially available Fresnel lens.

Referring now back to FIG. 1A and FIG. 1B, there is shown generally at 56 a video camera oriented to view forward of the front face of solid state lamp 10 and 30, respectively. The view of this video camera 56 is precisionally aligned to view along and generally parallel to the central longitudinal axis shown at 58 that the beam of light generated by the internal LED array is oriented. Specifically, at large distances, such as greater than 20 feet, the video camera 56 generates an image having a center of the image generally aligned with the center of the light beam directed down the center axis 58. This allows the field technician to remotely electronically align the orientation of the light beam referencing this video image.

Figure 14A:
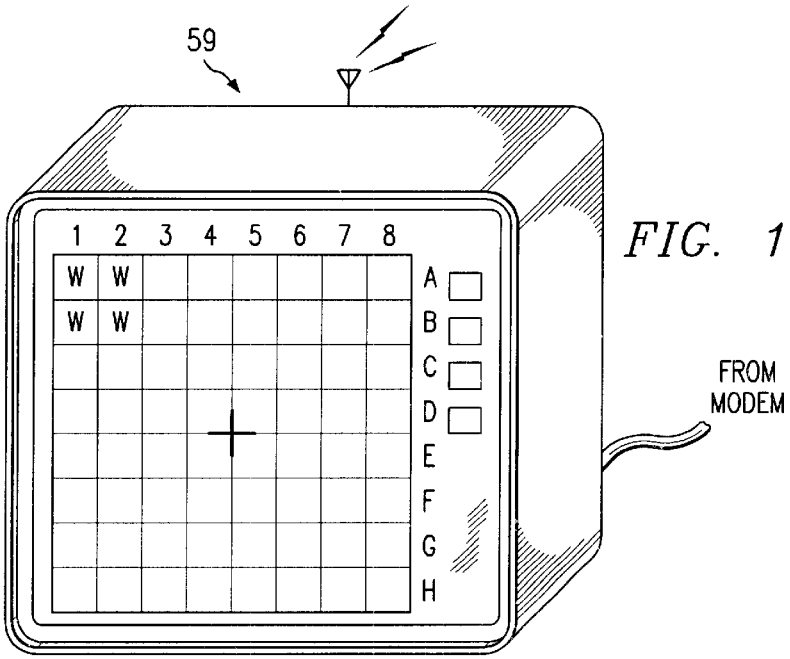
FIG. 14A is a view of a remote monitor displaying an image generated by a video camera in the light apparatus to facilitate electronic alignment of the LED light beam.

For instance, in one preferred embodiment the control electronics 60 has software generating and overlaying a grid along with the video image for display at a remote display terminal, such as a LCD or CRT display shown at 59 in FIG. 14A. This video image is transmitted electronically either by wire using a modem, or by wireless communication using a transmitter allowing the field technician on the ground to ascertain that portion of the road that is in the field of view of the generated light beam. By referencing this displayed image, the field technician can program which LEDs 42 should be electronically turned on, with the other LEDs 42 remaining off, such that the generated light beam will be focused by the associated optics including the Fresnel lens 72, to the proper lane of traffic. Thus, on the ground, the field technician can electronically direct the generated light beam from the LED arrays, by referencing the video image, to the proper location on the ground without mechanical adjustment at the light source, such as by an operator situated in a DOT bucket. For instance, if it is intended that the objects viewable and associated with the upper four windows defined by the grid should be illuminated, such as those objects viewable through the windows labeled as W in FIG. 14A, the LEDs 42 associated with the respective windows "W" will be turned on, with the rest of the LEDs 46 associated with the other windows being turned off. Preferably, there is one LED 46 associated with each window defined by the grid. Alternatively, a transparent sheet 73 having a grid 74 defining windows 78 can be laid over the display surface of the remote monitor 59 whereby each window 78 corresponds with one LED. For instance, there may be 64 windows associated with the 64 LEDs of the LED array. Individual control of the respective LEDs is discussed hereafter in reference to FIG. 14A. The video camera 56, such as a CCD camera or a CMCS camera, is physically aligned alone the central axis 58, such that at extended distances the viewing area of the camera 56 is generally along the axis 58 and thus is optically aligned with regards to the normal axis 58 for purposes of optical alignment.

Figure 14B:
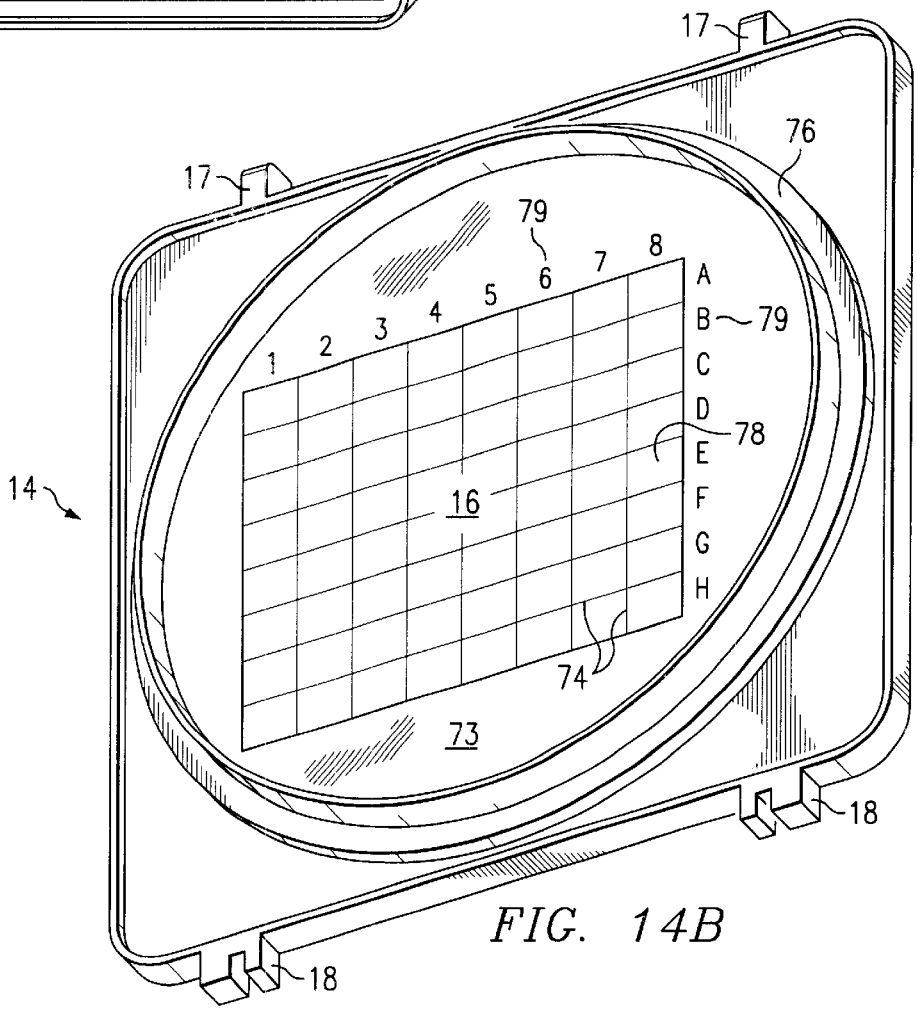
FIG. 14B is a perspective view of the lid of the apparatus shown in FIG. 1 having a grid overlay for use with the optical alignment system.

Referring now to FIG. 14B, there is illustrated the lid 14, the hinge members 17, and the respective latches 18. Holder 14 is seen to further have an annular flange member 70 defining a side wall about window 16, as shown. Further shown the transparent sheet 73 and grid 74 comprising of thin line markings defined over openings 16 defining windows 78. The sheet can be selectively placed over window 16 for alignment, and which is removable therefrom after alignment. Each window 78 is precisionally aligned with and corresponds to one sixty four (64) LEDs 42. Indicia 79 is provided to label the windows 78, with the column markings preferably being alphanumeric, and the columns being numeric. The windows 78 are viable through optical sight member 28, via an opening in heatsink 20. The objects viewed in each window 78 are illuminated substantially by the respective LED 42, allowing a technician to precisionally orient the apparatus 10 so that the desired LEDs 42 are oriented to direct light along a desired path and be viewed in a desired traffic lane. The sight member 28 may be provided with cross hairs to provide increased resolution in combination with the grid 74 for alignment.

Moreover, electronic circuitry 100 on daughterboard 60 can drive only selected LEDs 42 or selected 4×4 portions of array 40, such as a total of 16 LED's 42 being driven at any one time. Since different LED's have lenses 86 with different radius of curvature different thicknesses, or even comprised of different materials, the overall light beam can be electronically steered in about a 15° cone of light relative to a central axis defined by window 16 and normal to the array center axis.

For instance, driving the lower left 4×4 array of LEDs 42, with the other LEDs off, in combination with the diffuser 50 and lens 70 and 72, creates a light beam +7.5 degrees above a horizontal axis normal to the center of the 8×8 array of LEDs 42, and +7.5 degrees right of a vertical axis. Likewise, driving the upper right 4×4 array of LEDs 42 would create a light beam +10 degrees off the horizontal axis and +7.5 degrees to the right of a normalized vertical axis and −7.5 degrees below a vertical axis. The radius of curvature of the center lenses 86 may be, for instance, half that of the peripheral lenses 86. A beam steerable +/−7.5 degrees in 1–2 degree increments is selectable. This feature is particularly useful when masking the opening 16, such as to create a turn arrow. This further reduces ghosting or roll-off, which is stray light being directed in an unintended direction and viewable from an unintended traffic lane.

The electronically controlled LED array provides several technical advantages including no light is blocked, but rather is electronically steered to control a beam direction. Low power LEDs are used, whereby the small number of the LEDs "on" (i.e. 4 of 64) consume a total power about 1–2 watts, as opposed to an incandescent prior art bulb consuming 150 watts or a flood 15 watt LED which are masked or lowered. The present invention reduces power and heat generated thereby.

Figure 15:
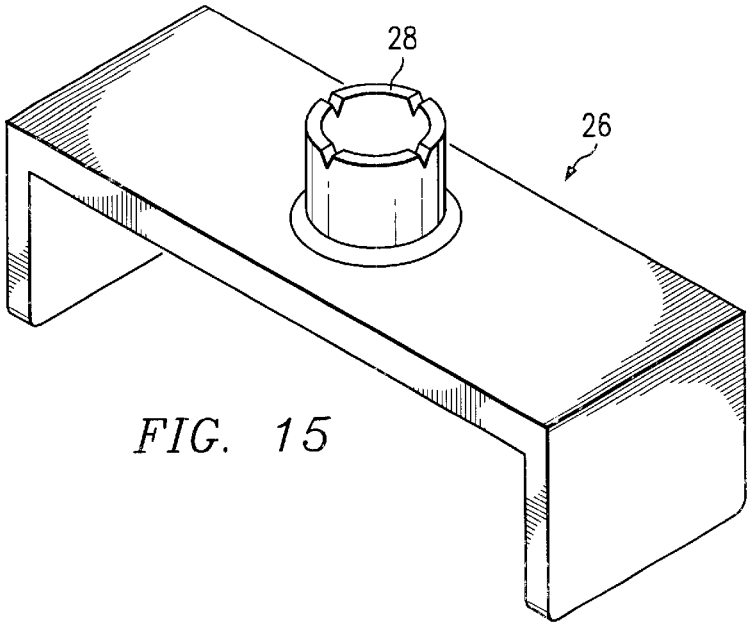
FIG. 15 is a perspective view of the optical alignment system eye piece adapted to connect to the rear of the light unit shown in FIG. 1.

Referring now to FIG. 15, there is shown a perspective view of the eye piece 26 as well as the optical sight member 28, as shown in FIG. 1. the center axis of optical sight member 28 is oriented along the center of the 8×8 LED array.

Referring now to FIG. 16, there is shown at 100 a schematic diagram of the circuitry controlling light apparatus 10. Circuit 10 is formed on the daughter board 60, and is electrically connected to the LED solid state light source 40, and selectively drives each of the individual LEDs 42 comprising the array. Depicted in FIG. 16 is a complex programmable logic device (CPLD) shown as U1. CPLD U1 is preferably an off-the-shelf component such as provided by Maxim Corporation, however, limitation to this specific part is not to be inferred. For instance, discrete logic could be provided in place of CPLD U1 to provide the functions as is described here, with it being understood that a CPLD is the preferred embodiment is of the present invention. CPLD U1 has a plurality of interface pins, and this embodiment, shown to have a total of 144 connection pins. Each of these pin are numbered and shown to be connected to the respective circuitry as will now be described.

Shown generally at 102 is a clock circuit providing a clock signal on line 104 to pin 125 of the CPLD U1. Preferably, this clock signal is a square wave provided at a frequency of 32.768 KHz. Clock circuit 102 is seen to include a crystal oscillator 106 coupled to an operational amplifier U5 and includes associated trim components including capacitors and resistors, and is seen to be connected to a first power supply having a voltage of about 3.3 volts.

Still referring to FIG. 16, there is shown at 110 a power up clear circuit comprised of an operational amplifier shown at U6 preferably having the noninverting output coupled to pin 127 of CPLD U1. The inverting input is seen to be coupled between a pair of resistors providing a voltage divide circuit, providing approximately a 2.425 volt reference signal based on a power supply of 4.85 volts being provided to the positive rail of the voltage divide network. The inverting input is preferably coupled to the 4.85 voltage reference via a current limiting resistor, as shown.

As shown at 112, an operational amplifier U9 is shown to have its non-inverting output connected to pin 109 of CPLD U1. Operational amplifier U9 provides a power down function.

Referring now to circuit 120, there is shown a light intensity detection circuit detecting ambient light intensity and comprising of a photodiode identified as PD1. An operational amplifier depicted as U7 is seen to have its noninverting input coupled to input pin 99 of CPLD U1. The non-inverting input of amplifier U7 is connected to the anode of photodiode PD1, which photodiode has its cathode connected via a capacitor to the second power supply having a voltage of about 4.85 volts. The non-inverting input of amplifier U7 is also connected via a diode Q1, depicted as a transistor with its emitter tied to its base and provided with a current limiting resistor. The inverting input of amplifier U7 is connected via a resistor to input 108 of CPLD U1.

Shown at 122 is a similar light detection circuit detecting the intensity of backscattered light from Fresnel lens 72 as shown at 124 in FIG. 3, and based around a second photodiode PD2, including an amplifier U10 and a diode Q2. The non-inverting output of amplifier U10, forming a buffer, is connected to pin 82 of CPLD U1.

An LED drive connector is shown at 130 serially interfaces LED drive signal data to drive circuitry of the LEDs 42. (Inventors please describe the additional drive circuit schematic).

Shown at 140 is another connector adapted to interface control signals from CPLD U1 to an initiation control circuit for the LED's.

Each of the LEDs 42 is individually controlled by CPLD U1 whereby the intensity of each LED 42 is controlled by the CPLD U1 selectively controlling a drive current thereto, a drive voltage, or adjusting a duty cycle of a pulse width modulation (PWM) drive signal, and as a function of sensed optical feedback signals derived from the photodiodes as will be described shortly here, in reference to FIG. 17.

Figure 17:
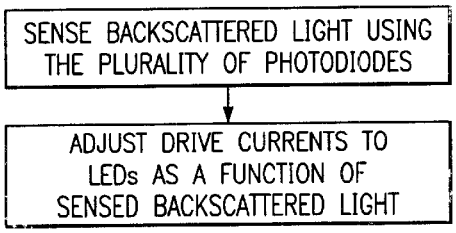
FIG. 17 is an algorithm depicting the sensing of ambient light and backscattered light to selectably provide a constant output of light.

Referring to FIG. 17 in view of FIG. 3, there is illustrated how light generated by solid state LED array 40 is diffused by diffuser 50, and a small portion 124 of which is back-scattered by the inner surface of Fresnel lens 72 back toward the surface of daughter board 60. The back-scattered diffused light 124 is sensed by photodiodes PD2, shown in FIG. 16. The intensity of this back-scattered light 124 is measured by circuit 122 and provided to CPLD U1. CPLD U1 measures the intensity of the ambient light via circuit 120 using photodiode PD1. The light generated by LED's 42 is preferably distinguished by CPLD U1 by strobing the LEDs 42 using pulse width modulation (PWM) to discern ambient light (not pulsed) from the light generated by LEDs 42.

CPLD U1 individually controls the drive current, drive voltage, or PWM duty cycle to each of the respective LEDs 42 as a function of the light detected by circuits 120 and 122. For instance, it is expected that between 3 and 4% of the light generated by LED array 40 will back-scatter back from the Fresnel lens 72 toward to the circuitry 100 disposed on daughter board 60 for detection. By normalizing the expected reflected light to be detected by photodiodes PD2 in circuit 122, for a given intensity of light to be emitted by LED array 40 through window 16 of lid 14, optical feedback is used to ensure an appropriate light output, and a constant light output from apparatus 10.

For instance, if the sensed back-scattered light, depicted as rays 124 in FIG. 3, is detected by photodiodes PD2 to fall about 2.5% from the normalized expected light to be sensed by photodiodes PD2, such as due to age of the LEDs 42, CPLD U1 responsively increases the drive current to the LEDs a predicted percentage, until the back-scattered light as detected by photodiodes PD2 is detected to be the normalized sensed light intensity. Thus, as the light output of LEDs 42 degrade overtime, which is typical with LEDs, circuit 100 compensates for such degradation of light output, as well as for the failure of any individual LED to ensure that light generated by array 40 and transmitted through window 16 meets Department of Transportation (DOT) standards, such as a 44point test. This optical feedback compensation technique is also advantageous to compensate for the temporary light output reduction when LEDs become heated, such as during day operation, known as the recoverable light, which recoverable light also varies over temperatures as well. Permanent light loss is over time of operation due to degradation of the chemical composition of the LED semiconductor material.

Preferably, each of the LEDs is driven by a pulse width modulated (PWM) drive signal, providing current during a predetermined portion of the duty cycle, such as for instance, 50%. As the LEDs age and decrease in light output intensity, and also during a day due to daily temperature variations, the duty cycle may be responsively, slowly and continuously increased or adjusted such that the duty cycle is appropriate until the intensity of detected light by photodiodes PD2 is detected to be the normalized detected light. When the light sensed by photodiodes PD2 are determined by controller 60 to fall below a predetermined threshold indicative of the overall light output being below DOT standards, a notification signal is generated by the CPLD U1 which may be electronically generated and transmitted by an RF modem, for instance, to a remote operator allowing the dispatch of service personnel to service the light. Alternatively, the apparatus 10 can responsively be shut down entirely.

Figure 18B:
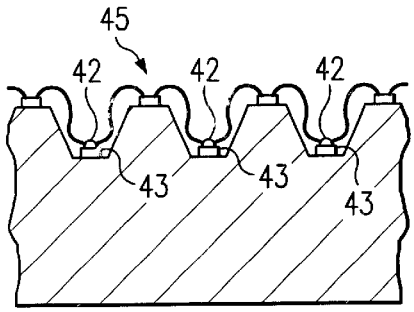
FIG. 18A and FIG. 18B are side sectional views of an alternative preferred embodiment including a heatsink with recesses, with the LED's wired in parallel and series, respectively.
Figure 18A:
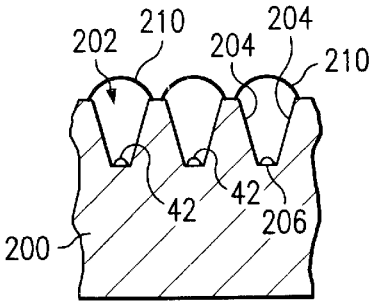

Referring now to FIG. 18A and FIG. 18B, there is shown an alternative preferred embodiment of the present invention including a heatsink 200 machined or stamped to have an array of reflectors 202. Each recess 202 is defined by outwardly tapered sidewalls 204 and a base surface 208, each recess 202 having mounted thereon a respective LED 42. A lens array having a separate lens 210 for each LED 42 is secured to the heatsink 200 over each recess 202, eliminating the need for a lens holder. The tapered sidewalls 206 serve as light reflectors to direct generated light through the respective lens 210 at an appropriate angle to direct the associated light to the diffuser 50 having the same surface area of illumination for each LED 42. In one embodiment, as shown in FIG. 18A, LEDs 42 are electrically connected in parallel. The cathode of each LED 42 is electrically coupled to the electrically conductive heatsink 200, with a respective lead 212 from the anode being coupled to drive circuitry 216 disposed as a thin film PCB 45 adhered to the surface of the heatsink 200, or defined on the daughterboard 60 as desired. Alternatively, as shown in FIG. 18B, each of the LED's may be electrically connected in series, such as in groups of three, and disposed on an electrically non-conductive thermally conductive material 43 such as ceramic, diamond, SiN or other suitable materials. In a further embodiment, the electrically non-conductive thermally conductive material may be formed in a single process by using a semiconductor process, such as diffusing a thin layer of material in a vacuum chamber, such as 8000 Angstroms of SiN, which a further step of defining electrically conductive circuit traces 45 on this thin layer.

Figure 19:
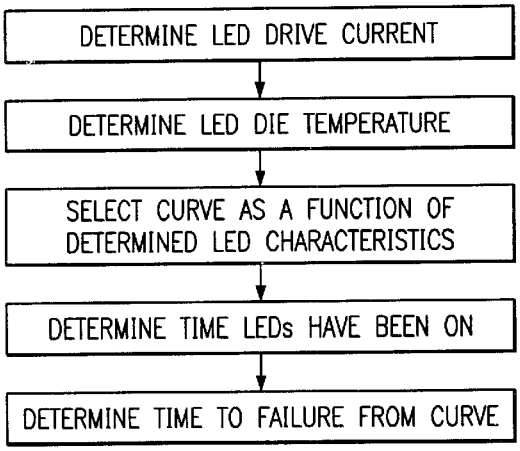
FIG. 19 is an algorithm depicting generating information indicative of the light operation, function and prediction of when the said state apparatus will fail or provide output below acceptable light output.
Figure 16A:
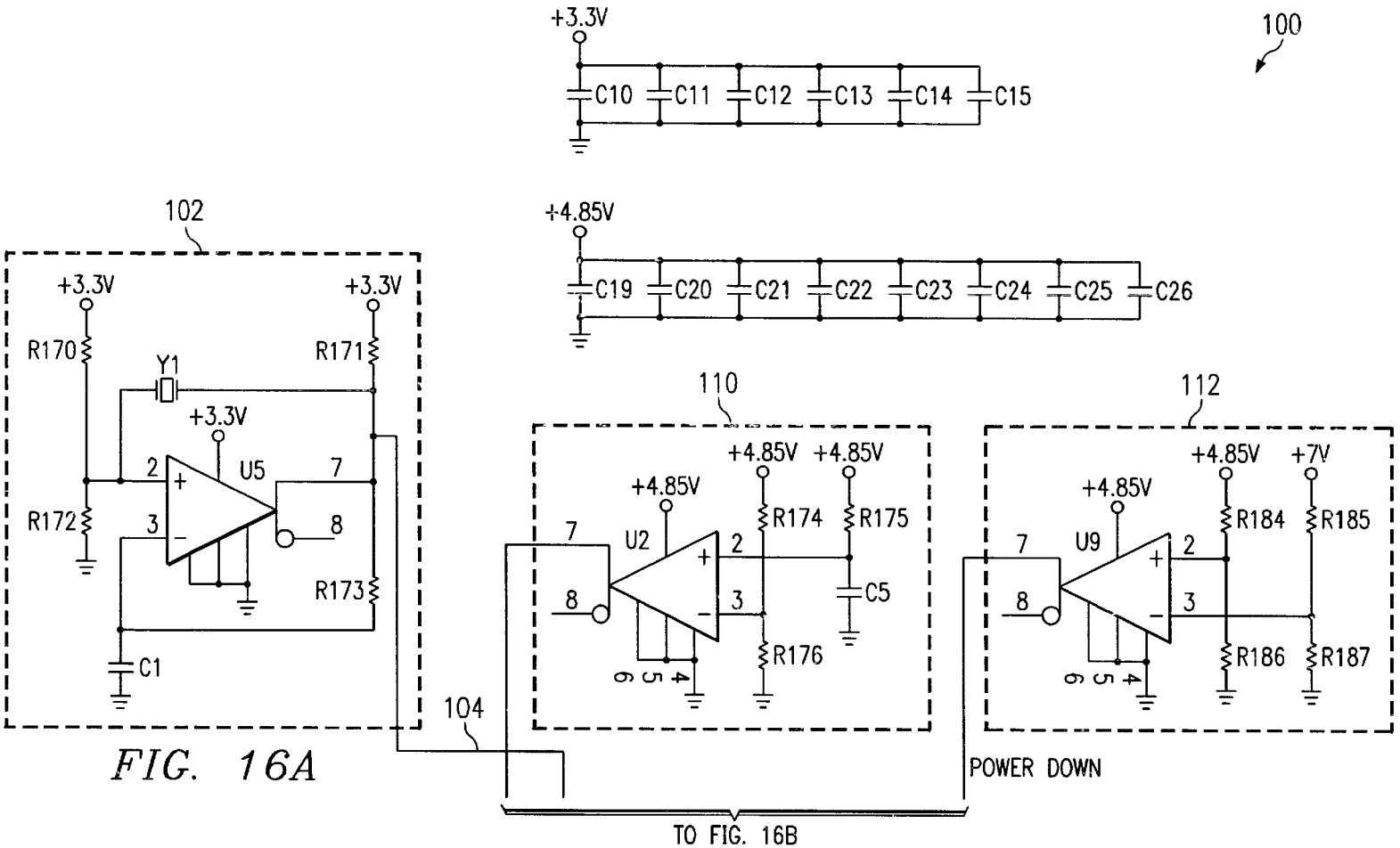
FIG. 16 is a schematic diagram of the control circuitry disposed on the daughterboard and incorporating various features of the invention including control logic, as well as light detectors for sensing ambient light and reflected generated light from the light diffuser used to determine and control the light output from the solid state light.
Figure 16B:
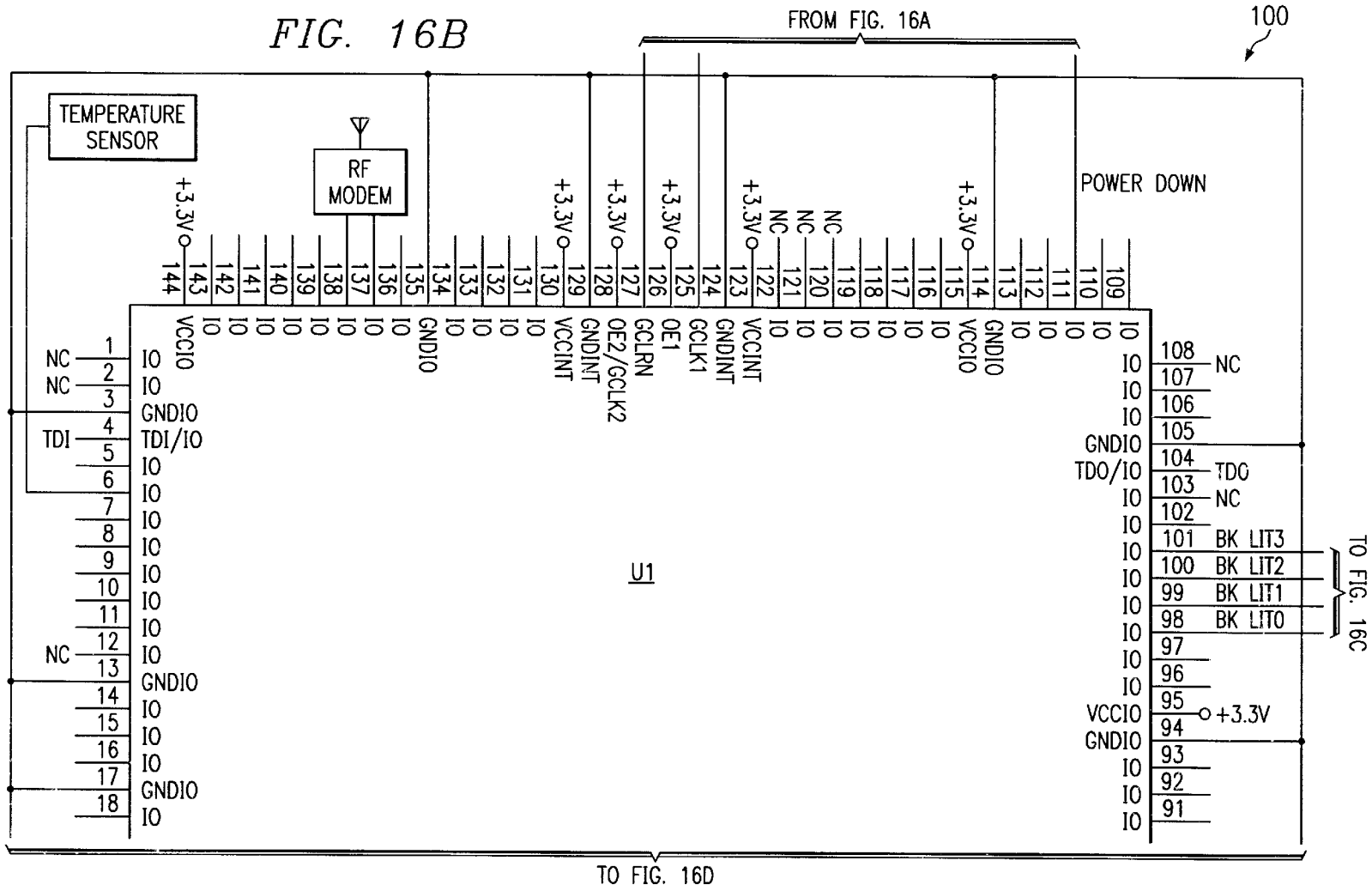
Figure 16C:
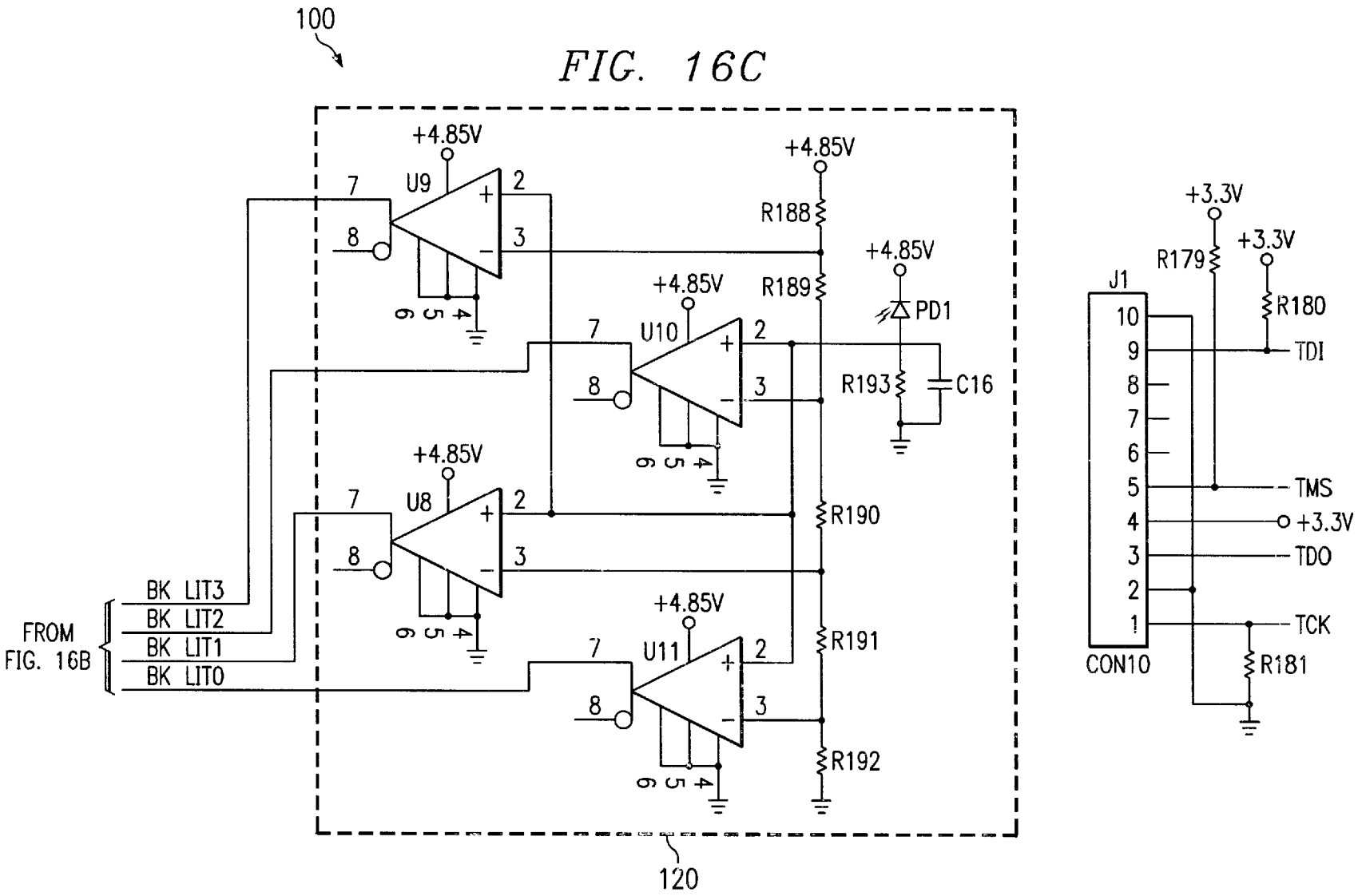
Figure 16D:
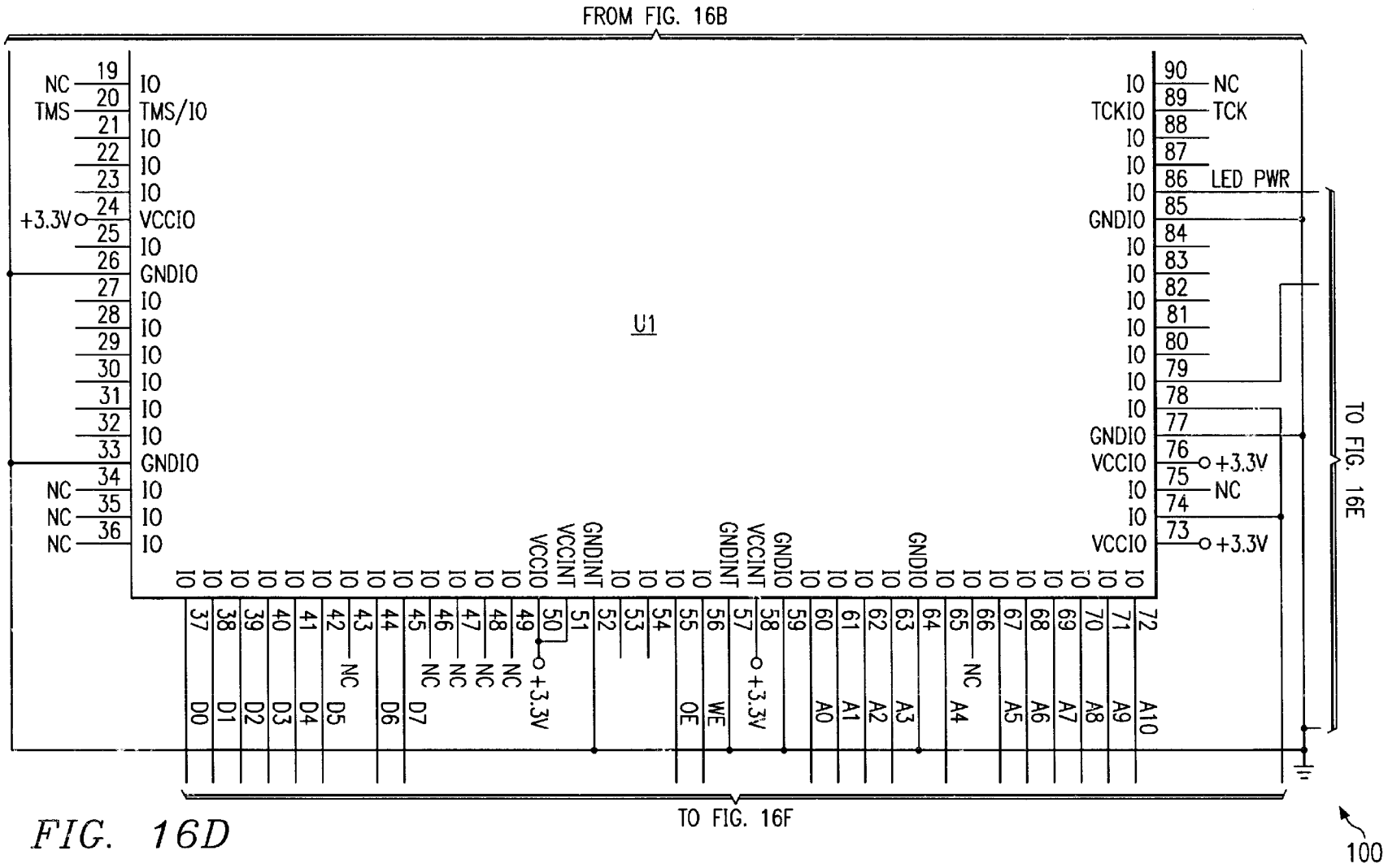
Figure 16E:
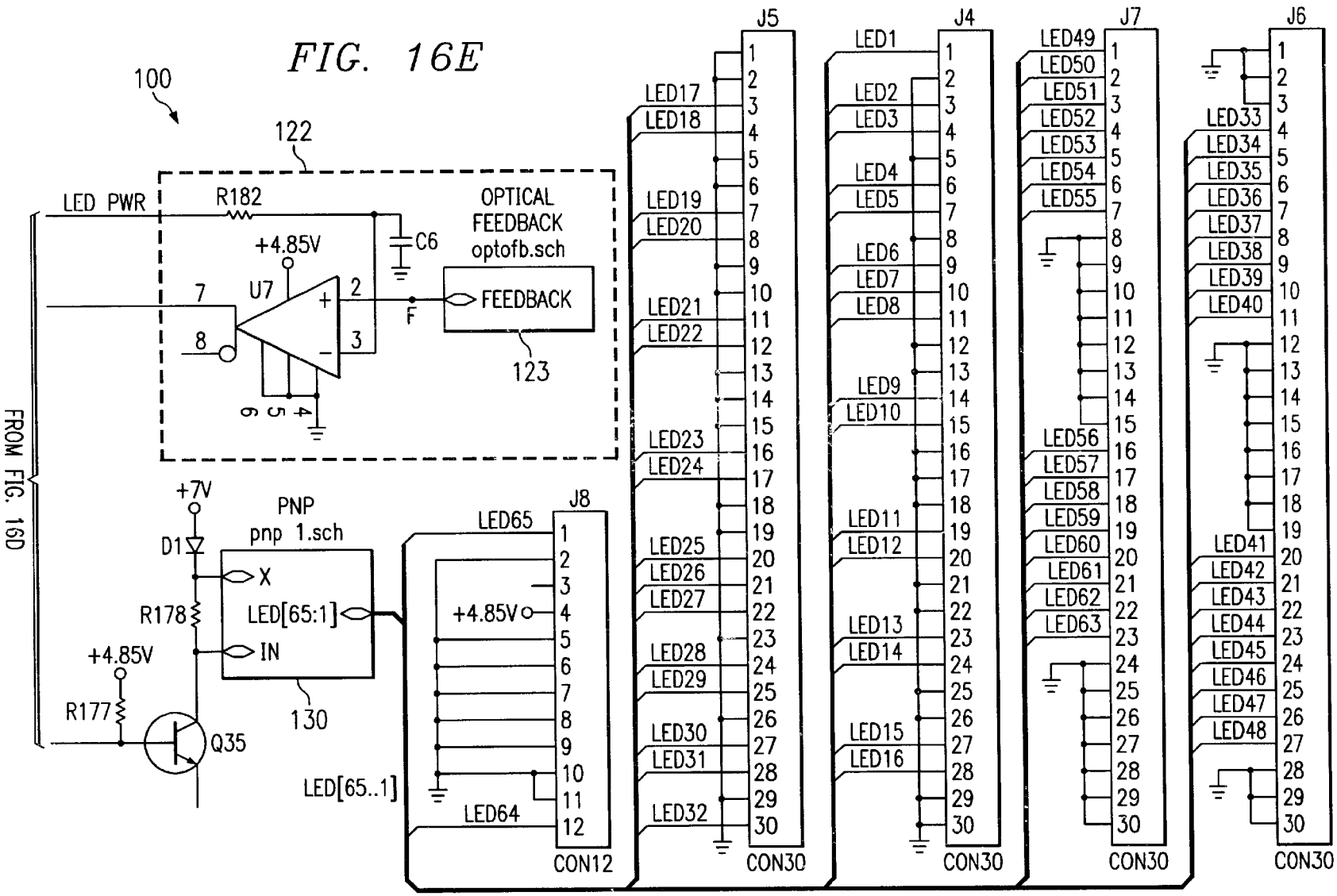
Figure 16F:
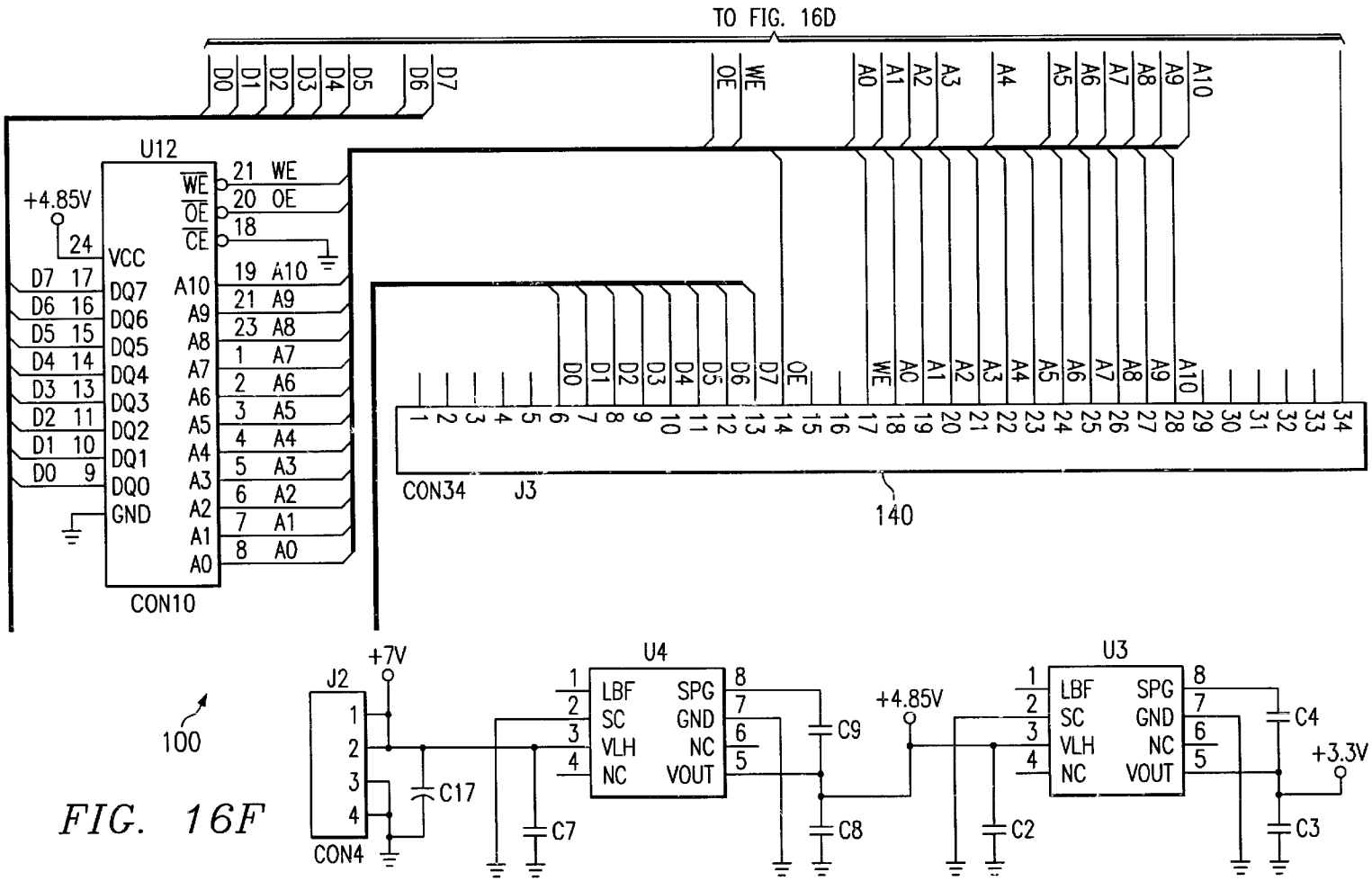
Figure 16G:
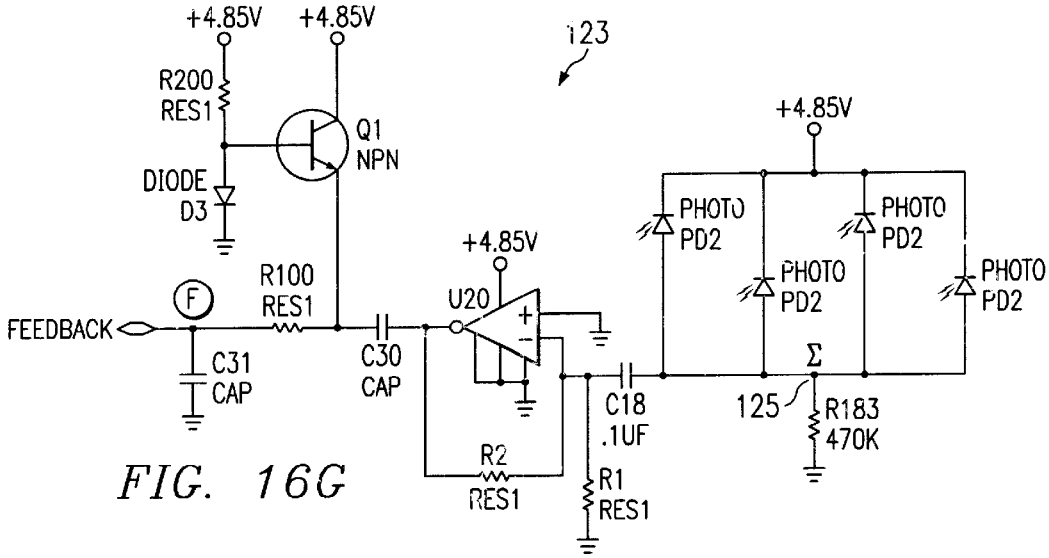
Figure 16I:
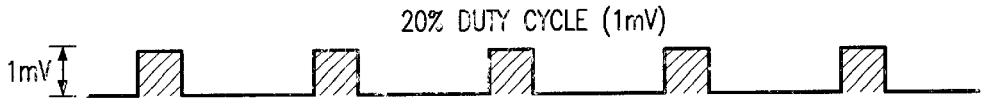
Figure 16J:
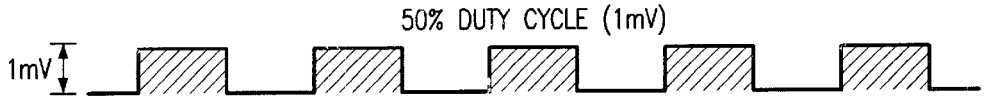
Figure 16K:
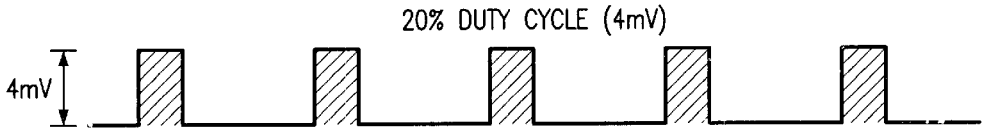
Figure 16H:
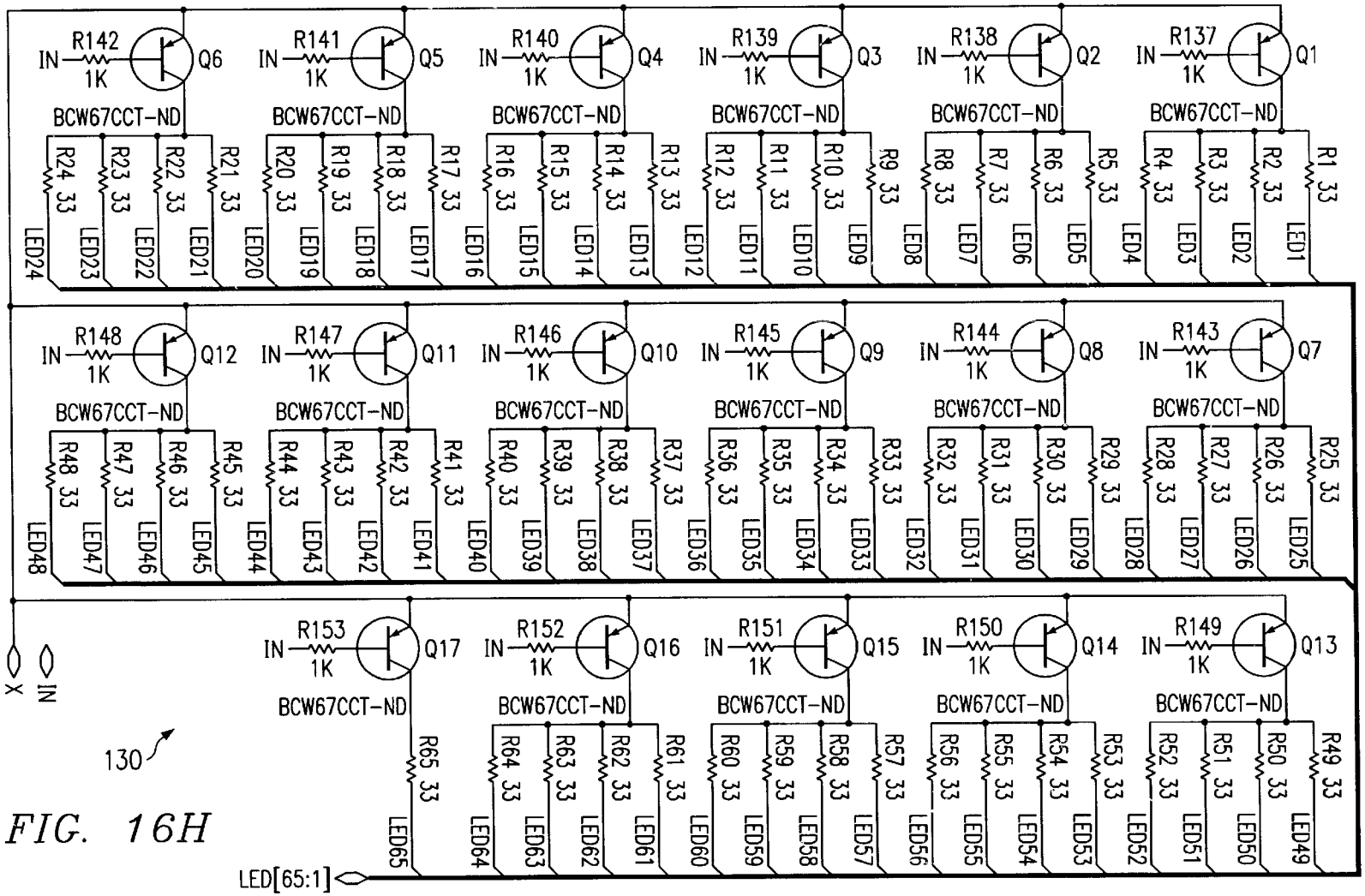
Figure 20:
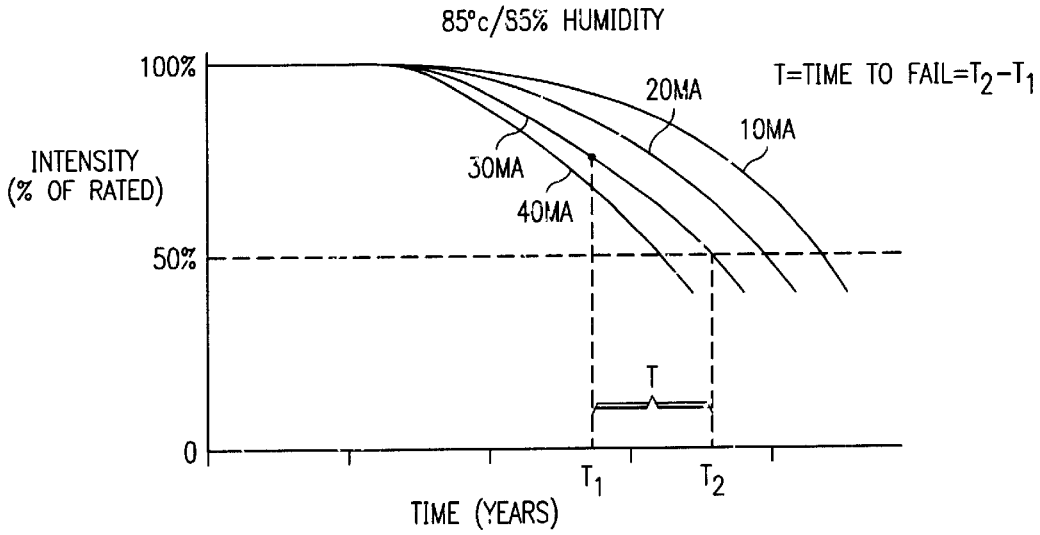
FIGS. 20 and 21 illustrate operating characteristics of the LEDs as a function of PWM duty cycles and temperature as a function of generated output light.
Figure 21:
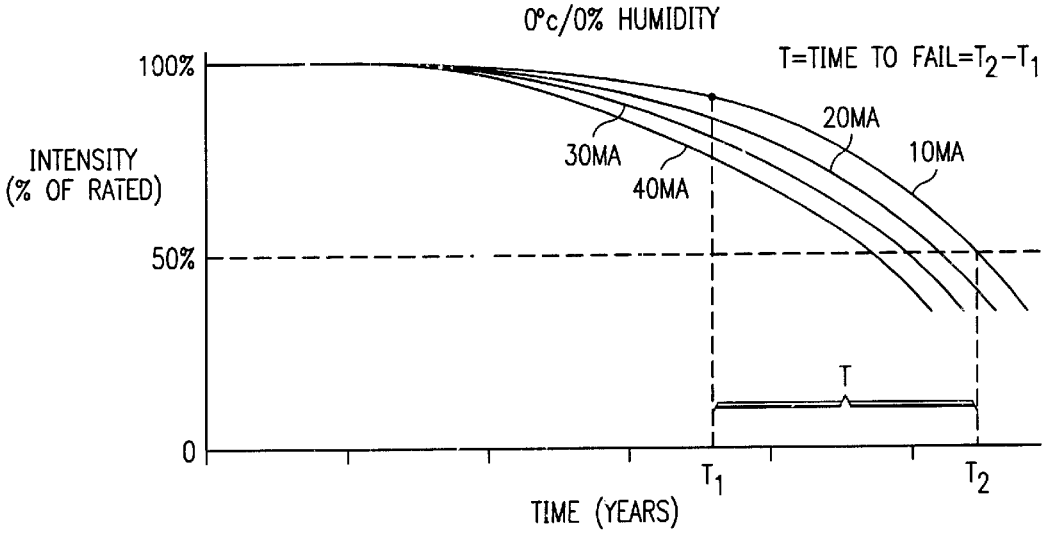

FIG. 19 shows an algorithm controller 60 applies for predicting when the solid state light apparatus will fail, and when the solid state light apparatus will produce a beam of light having an intensity below a predetermined minimum intensity such as that established by the DOT. Referring to the graphs in FIGS. 20 and 21, the known operating characteristics of the particular LEDs produced by the LED manufacture are illustrated and stored in memory, allowing the controller 60 to predict when the LED is about the fail. Knowing the LED drive current operating temperature, and total time the LED as been on, the controller 60 determines which operating curve in FIG. 20 and FIG. 21 applies to the current operating conditions, and determines the time until the LED will degrade to a performance level below spec, i.e. below DOT minimum intensity requirements.

Figure 22:
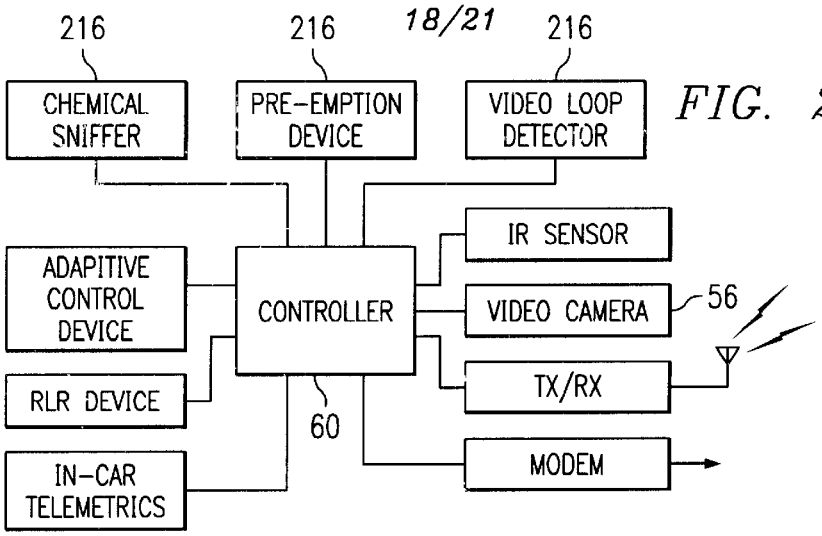
FIG. 22 is a block diagram of a modular light apparatus having selectively interchangeable devices that are field replaceable.

FIG. 22 depicts a block diagram of the modular solid state traffic light device. The modular field-replaceable devices are each adapted to selectively interface with the control logic daughterboard 60 via a suitable mating connector set. Each of these modular field replacable devices 216 are preferably embodied as a separate card, with possibly one or more feature on a single field replacable card, adapted to attach to daughterboard 60 by sliding into or bolting to the daughterboard 60. The devices can be selected from, alone or in combination with, a pre-emption device, a chemical sniffer, a video loop detector, an adaptive control device, a red light running (RLR) device, and an in-car telematic device, infrared sensors to sense people and vehicles under fog, rain, smog and other adverse visual conditions, automobile emission monitoring, various communication links, electronically steerable beam, exhaust emission violations detection, power supply predictive failure analysis, or other suitable traffic devices.

The solid state light apparatus 10 of the present invention has numerous technical advantages, including the ability to sink heat generated from the LED array to thereby reduce the operating temperature of the LEDs and increase the useful life thereof. Moreover, the control circuitry driving the LEDs includes optical feedback for detecting a portion of the back-scattered light from the LED array, as well as the intensity of the ambient light, facilitating controlling the individual drive currents, drive voltages, or increasing the duty cycles of the drive voltage, such that the overall light intensity emitted by the LED array 40 is constant, and meets DOT requirements. The apparatus is modular in that individual sections can be replaced at a modular level as upgrades become available, and to facilitate easy repair. With regards to circuitry 100, CPLD U1 is securable within a respective socket, and can be replaced or reprogrammed as improvements to the logic become available. Other advantages include programming CPLD U1 such that each of the LEDs 42 comprising array 40 can have different drive currents or drive voltages to provide an overall beam of light having beam characteristics with predetermined and preferably parameters. For instance, the beam can be selectively directed into two directions by driving only portions of the LED array in combination with lens 70 and 72. One portion of the beam may be selected to be more intense than other portions of the beam, and selectively directed off axis from a central axis of the LED array 40 using the optics and the electronic beam steering driving arrangement.

Figure 24:
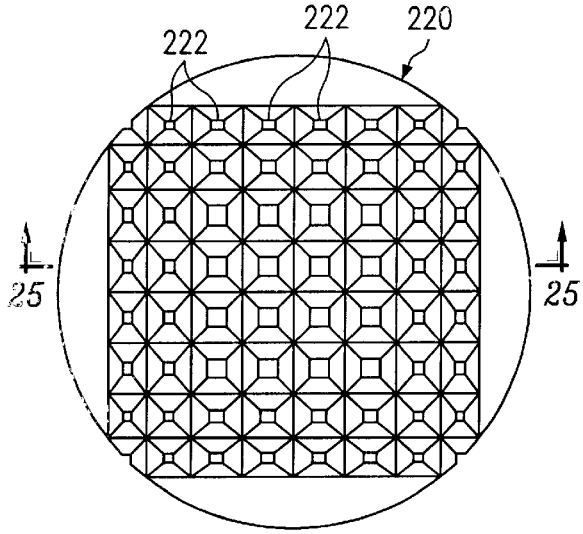
FIG. 24 shows a top view of FIG. 23 of the light guide for use with the diffuser.
Figure 23:
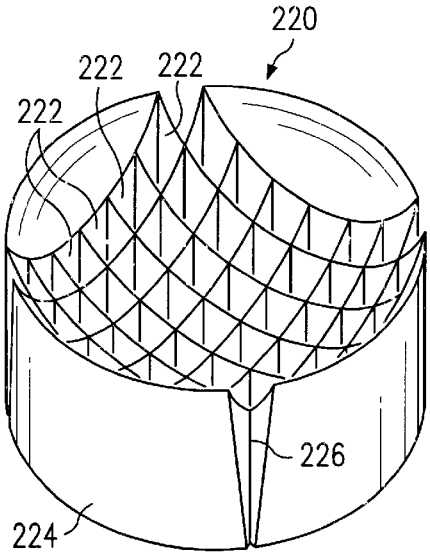
FIG. 23 is a perspective view of a light guide having a light channel for each LED to direct the respective LED light to the diffuser.
Figure 25:
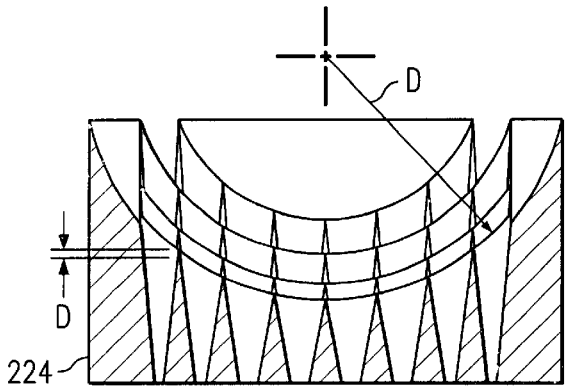
FIG. 25 shows a side sectional view taken along line 24—24 in FIG. 3 illustrating a separate light guide cavity for each LED extending to the light diffuser.

Referring now to FIG. 23, there is shown at 220 a light guide device having a concave upper surface and a plurality of vertical light guides shown at 222. One light guide 222 having a light reflective inner surface is provided for and positioned over each LED 42, which light guide 222 upwardly directs the light generated by the respective LED 42 to impinge the bottom convex surface of the concave diffuser 54. The light guides 222 taper outwardly at a top end thereof, as shown in FIG. 24 and FIG. 25, such that the area at the top of each light guide 222 is identical. Thus, each LED 42 illuminates an equal surface area of the light diffuser 54, thereby providing a uniform intensity light beam from light diffuser 54. A thin membrane 224 defines the light guide, like a honeycomb, and tapers outwardly to a point edge at the top of the device 220. These point edges are separated by a small vertical distance D shown in FIG. 25, such as 1 mm, from the above diffuser 54 to ensure uniform lighting at the transition edges of the light guides 222 while preventing bleeding of light laterally between guides, and to prevent light roll-off by generating a homogeneous beam of light. Vertical recesses 226 permit standoffs 52 extending along the sides of device 220 (see FIG. 3) to support the peripheral edge of the diffuser 54. The lateral light guides are narrower than the central light guides due to the upward curvature of the diffuser edges.

Figure 26:
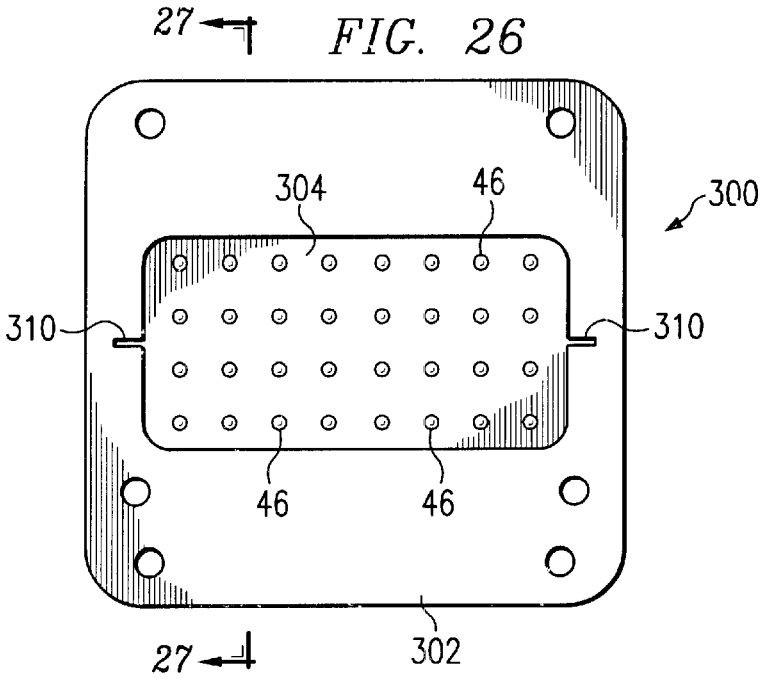
FIG. 26 is a top view of an LED light source including a single reflector with an array of LEDs, therein, the cavity which can be selectively masked through responsively determining the angle that light is ultimately transmitted from a lens disposed thereover.
Figure 28:
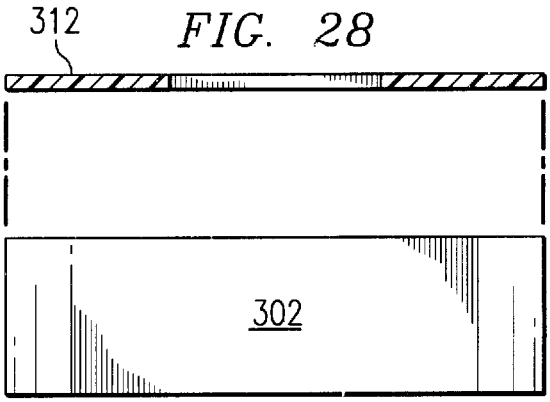
FIG. 28 is a exploded side view of the housing cavity and a light diffuser/cover disposed thereover.

Referring now to FIG. 26, there is shown generally at 300 another preferred embodiment of the present invention including a single cavity LED light apparatus having a single reflector, shown as a trough, the LED area array being covered with a light diffuser, as shown in FIG. 28. The single cavity LED apparatus is selectively masked to establish a desired beam angle and shape emitted by the Fresnel lens, as shown in FIG. 28.

Figure 27:
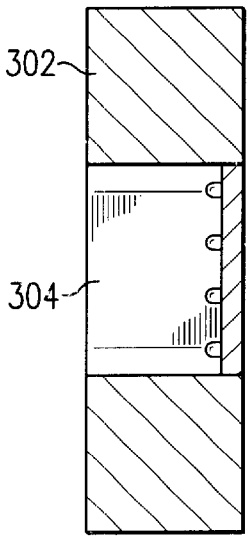
FIG. 27 is a side sectional view taken along line 27—27 in FIG. 26.

A rectangular housing member shown at 302 defines a central rectangular cavity 304 with an array of LEDs 46 disposed therein. As shown, the LEDs 46 are disposed in a 4×8 area array, each LED 46 facing upwardly from a heatsink, as discussed in other embodiments, and each LED 46 preferably comprising an LED die such as a vertical cavity surface emitting laser (VCSEL). As shown in FIG. 27, the thickness of the housing 302 is approximately 1 inch, having a length of about 2.5 inches and a width of about 3 inches. The dimensions of the cavity 304 are approximately 1.1 inches in width, and 2.3 inches in length. Also shown in FIG. 26 is a pair of opposing key slots 310 which facilitate a vertical light separation member to be vertically inserted therein to separate the upper portion of the LED array from the lower portion of the LED array.

Preferably, the LEDs 46 are comprised of two or more different colors, a plurality of one color forming a first set, such as green LEDs generating green light, and a plurality of another LED color, such as yellow LEDs generating yellow LED light, these colored LEDs being mixed throughout the array. Other colors are possible, such as red and amber LEDS. The plurality of LEDs 46 provide for redundancy, and the difference in colors provide the option to generate more than one color of light from the single LED light apparatus 300.

Referring to FIG. 28, there is seen that the cover 312 comprising a holographic diffuser is secured to the top surface of the housing 302. Referring to FIG. 29, there is seen the diffuser 312 has a window 314 comprised of a holographic material aligned with the opening 304 of the housing member 302. That is, the profile of the window 314 conforms to the profile of the window 304 of the underlying housing member 302.

Still referring to FIG. 29, there is shown at 320 a mask which is adapted to be selectively adhered to the surface of the cover 312 to selectively block a portion of window 314, such as using Velcro® material. By selectively blocking a portion of window 314, the mask restricts and blocks light from the associated underlying LEDs 46, thereby allowing light from the unmasked LEDs 46 to be transmitted through the unmasked holographic diffuser material, and ultimately through the Fresnel lens shown in the other Figures. Since the LEDs 46 that are directing light through the lens are positioned below a center axis of the Fresnel lens, the light beam will be transmitted through the lens at an angle steerable upwardly from the lens center with respect to a central normal axis to the Fresnel lens.

For instance, by blocking the upper two rows of LEDs 46 as shown in FIG. 26, only the lower two rows of LEDs 46 will generate light that is ultimately communicated through the Fresnel lens. In this embodiment, the light beam generated through the lens will be directed roughly 10° from the center axis of the LED and upwardly. This is due to the combination of the orientation of the effective LEDs with respect to the lens, and the fact that the lens is a Fresnel lens.

Alternatively, if, say, only the two left columns of the LEDs 46 are unblocked by mask 320 as shown in phantom lines at 322, the light beam generated through the lens is directed at an angle at approximately 20° to the right with respect to normal of the lens. Therefore, using the mask 320, the angle of light generated through the lens of the light apparatus can be adjusted roughly +/−10° in one direction, and +/−20° in a second dimension. This allows for the selective mechanical steering of the light beam generated by the solid state LED array to custom define the angle at which the homogenous light generated by the LED array is directed. This allows for the light to be focused toward the appropriate lane of traffic to be controlled.

It is further noted that the selective masking of the LEDs also responsively shapes the beam of the light being transmitted through the lens. For instance, a larger beam is generated by an unmasked LED array, and a narrower beam of light is generated by a substantially masked LED array. As shown in FIG. 29, if the upper portion of the LED array is masked, the beam will have a narrow and long beam extending laterally, and conversely, if the left half of the LED array is masked, the beam will be substantially square and uniform in both the vertical and lateral direction. The inner walls of opening 304 are preferably coated with a light reflective material to facilitate that all light generated from the LEDs 46 be directed upwardly through the light diffuser 312.

Referring now to FIG. 31, there is illustrated another advantageous use of the light apparatus 300 shown in FIG. 26 comprising a split-phase pedestrian head. As shown in FIG. 31, light apparatus 300 is provided with a rectangular light separator 330 vertically disposed within the respective slots 310, thereby physically separating the light generated by the upper row of LEDs 46 from the light generated by the lower row of LEDs 46, depicted as an upper LED section 332 and in lower LED section 334. Due to the optics, namely, the fact that the Fresnel lens is disposed over the apparatus 300, as graphically depicted in FIG. 32, when the upper two rows of LEDs 46 are illuminated, a light beam directed downwardly at about 10° with respect to normal is generated as shown at 340. Conversely, when the two lower rows of LEDs 46 are illuminated, with the upper two rows remaining off, the generated light beam is directed at a roughly 10° above the normal of the lens, as illustrated as 342.

Figure 33:
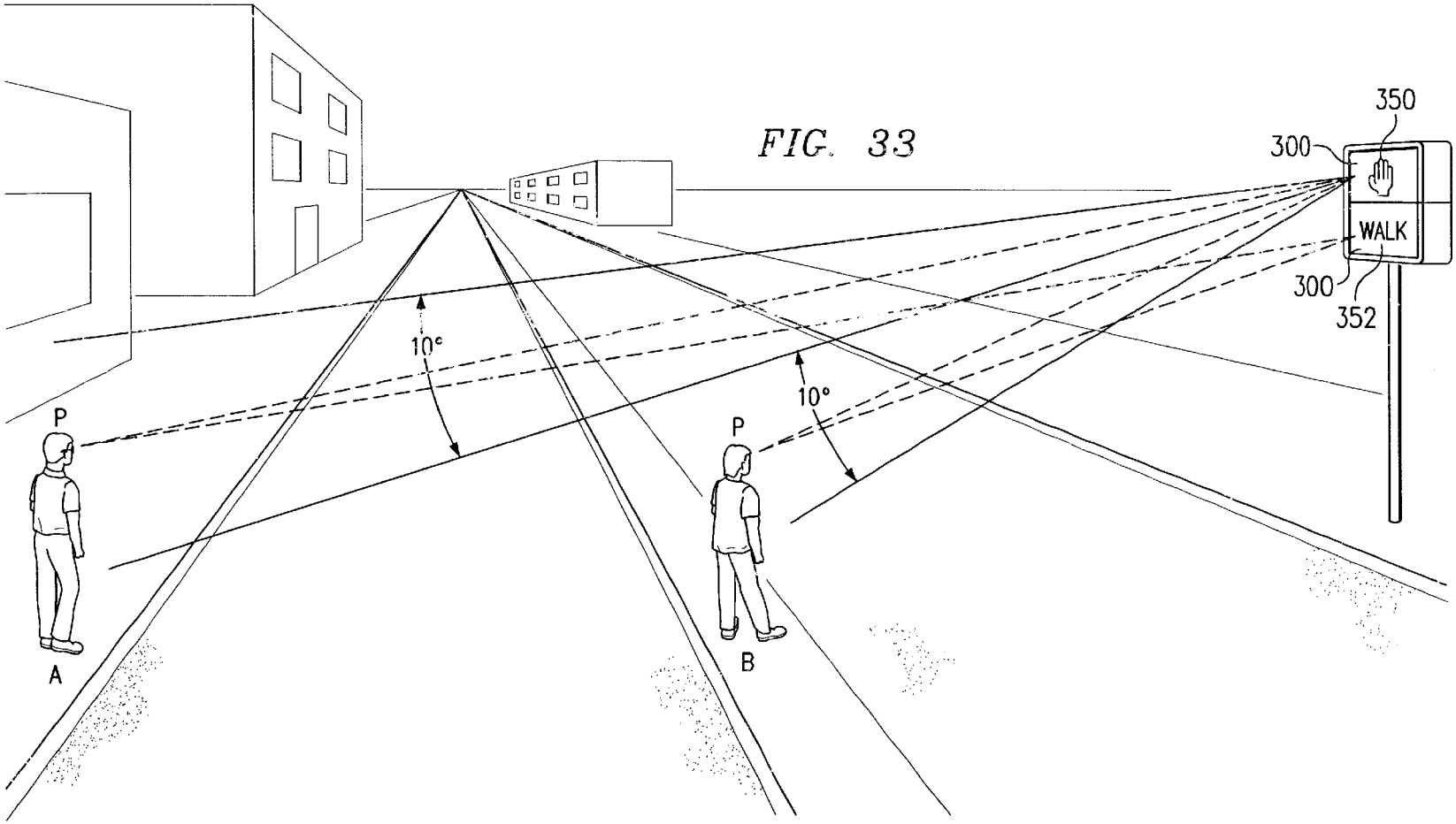
FIG. 33 depicts the operation of a pair of split-phase pedestrian head signals controlled to inform pedestrians at different locations of an intersection whether it is safe to walk.

With the novel light apparatus 300, a novel control algorithm of the same provides a split-phase light apparatus that finds one suitable use as a pair of split-phase pedestrian head signals. As depicted in FIG. 33, a pedestrian "P" at an opposing side of the street in position "A" from the pair of split-phase pedestrian heads can see light generated by the lower two rows of LEDs of the respective pedestrian heads. However, the pedestrian in position A cannot see light generated by the upper two rows of LEDs of the respective pedestrian heads.

Now referring to the pedestrian P at position "B", namely, at a median of a lane of traffic, this pedestrian can see the light beam generated by the upper rows of LEDs 46 of each pedestrian heads, but not the light from the lower two rows of LEDs of the pedestrian heads which are still only visible by the pedestrian at position A.

The present invention finds technical advantages whereby a pair of split-phase pedestrian heads 300, one stacked on top of the other as shown, can be used with the upper head 300 having a light screen shaped as a "stop hand" symbol 350, and the lower head 300 may be screened with a "walk" symbol 352. In a operational first state, i.e. when an associated traffic signal turns green, all LED rows of the lower walk signal 300 are illuminated such that the walk symbol 300 is illuminated and visible by pedestrian at both position A and at position B. However, at a second state in the cycle, only the upper two rows of the LEDs of lower lamp 300 are illuminated, thus, the illuminated walk symbol is viewable only by the pedestrian at position B due to the 10° beamwidth, and not by pedestrian at position A. Simultaneously, the upper "don't walk" pedestrian head 300 will have its lower two LED rows illuminated such that the "don't walk" signal is viewable by the pedestrian at position A due to the 10° beamwidth, but not by the pedestrian at position B who still only sees the illuminated "walk" signal.

At a third state of the cycle, namely, when the associated traffic signal is about to turn yellow, all LED rows of the upper head 300 are illuminated such that the "don't walk" signal is viewable by a pedestrian at both position A and position B, and all rows of the LEDs of the lower head 300 are off.

The present invention helps overcome the confusion and uncertainty of a pedestrian attempting to cross an associated traffic way, allowing the pedestrian to ascertain whether or not there is sufficient time to cross the traffic lane. The control circuitry selectively drives the rows of LEDs in each of the upper "don't walk" and lower "walk" pedestrian heads 300 such that a pedestrian can better ascertain the instructions as whether or not to cross the street, or to continue crossing the street once half way there across such as shown in position B. As illustrated, both the upper and lower ped heads 300 have a maximum viewing angle of 20°, and a viewing angle of only 100 when just either the lower two rows or the upper two rows of LEDs are illuminated. Again, the lower 10° beam is viewable when the associated upper two rows of LEDs are illuminated, and conversely, the upper 10° beam is viewable when the associated two lower rows of LEDs are illuminated. The entire 20° beam is generated when all associated four rows of LEDs of the respective ped head 300 are illuminated.

Referring back to FIG. 31, the divider 330 separates light generated by the upper two rows and the lower two rows of LEDs 46 from mixing with the other, thereby further achieving directionality of the ultimate light beam generated by the ped head 300 towards the pedestrian. This divider 330 is not noticeable by the pedestrian when all rows are illuminated, but when only the upper or lower two LED rows are illuminated, the 10° beam directionality of the generated light is further controlled to avoid bleeding and provided a sharper roll-off of the light so that the pedestrian at the light in position B will not see both a walk signal and a stop hand signal.

A three cycle methodology is provided whereby at first stage of the cycle all LED rows of the lower "walk" ped head 300 are illuminated such that the walk symbol is seen by the pedestrian at both position A and at position B.

At a second stage of the cycle, the upper two LED rows of the walk ped head 300 are illuminated such that the walk symbol is only viewable by a pedestrian at position B, and whereby the lower two LED rows of the upper "stop hand" ped head 300 are illuminated such that the stop hand symbol is only viewable by the pedestrian at position A, but not by the pedestrian at position B.

At the third stage of the cycle, all LED rows of the lower "walk" ped head 300 are off, and all rows of the LEDs of the upper "stop hand" ped head 300 are illuminated such that the "stop hand" symbol is viewable by pedestrians at both positions A and B.

While the invention has been described in conjunction with preferred embodiments, it should be understood that modifications will become apparent to those of ordinary skill in the art and that such modifications are therein to be included within the scope of the invention and the following claims.

I claim:

1. A solid state light apparatus, comprising:

a first area array of light emitting diodes (LEDs) having an upper portion and a lower portion;

a first lens disposed over said first LED array; and a control circuit selectively controlling each said first LED array portions, wherein said first LED array upper portion in combination with said first lens generates a first light beam in a first direction, wherein said first LED array lower portion generates a second light beam in a second direction being different than said first direction.

2. The solid state light as specified in claim 1 further comprising a divider disposed between said first LED array first portion and said first LED array second portion.

3. The solid state light as specified in claim 1 further comprising a first housing disposed about said first LED area array and having a height H, further comprising a first light diffuser disposed across said first housing and adapted to transmit both said first and second light beams.

4. The solid state light as specified in claim 3 wherein said first light beam and said second light beam are directed continuously adjacent one another.

5. The solid state light as specified in claim 3 wherein said first housing comprises an annular member having said height H.

6. The solid state light as specified in claim 5 wherein said first annular member has a rectangular shape.

7. The solid state light as specified in claim 6 further comprising a divider disposed between said first LED array upper and lower portions and extending along the length of said first rectangular annular member.

8. The solid state light as specified in claim 1 wherein said first light beam has a beam width of no more than 10°.

9. The solid state light as specified in claim 8 wherein said second light beam has a beam width of no more than 10°.

10. The solid state light as specified in claim 9 wherein said first light beam and said second light beam form a continuous 20° light beam.

11. The solid state light as specified in claim 1 further comprising a first indicia disposed proximate said first lens and adapted to be illuminated by both said first light beam and said second light beam, said first indicia, when illuminated, being indicative of a pedestrian "walk" symbol.

12. The solid state light as specified in claim 11 further comprising a a second area array of light emitting diodes (LEDs) having an upper portion and a lower portion;

a second lens disposed over said second LED array; and said control circuit selectively controlling said second LED array portions, wherein said second LED array upper portion in combination with said second lens generates a third light beam in said first direction, and said second LED array lower portion generates a fourth light beam in said second direction.

13. The solid state light as specified in claim 12 further comprising a second indicia disposed proximate said second lens and illuminated by said third and fourth light beam, said second indicia, when illuminated, being indicative of a pedestrian "don't walk" symbol.

14. The solid state light as specified in claim 13 wherein said first light beam and said third light beam are directed generally in said first direction, and said second light beam and said fourth light beam are directed generally in said second direction.

15. The solid state light as specified in claim 14 wherein said control circuit has a first state driving said first LED array to generate both said first light beam and said second light beam, a second state driving both said first and second LED array to generate said second and third light beam, and a third state driving said second LED array to generate said third and fourth light beam.

16. A method of signaling pedestrian traffic across a roadway using a solid state light apparatus, comprising:

a first area array of light emitting diodes (LEDs) having an upper portion and a lower portion;

a first lens disposed over said first LED array; and a control circuit selectively controlling each said first LED array portions, wherein said first LED array upper portion in combination with said first lens generates a first light beam in a first direction, wherein said first LED array lower portion generates a second light beam in a second direction being different than said first direction;

comprising the steps of:

a) generating said first light beam directed at a pedestrian at a far side of the roadway in a first state; and b) generating said second light beam directed at a pedestrian proximate a middle of the roadway in a second state.

17. The method as specified in claim 16, which said solid state light further comprises:

a second area array of light emitting diodes (LEDs) having an upper portion and a lower portion;

a second lens disposed over said second LED array; and said control circuit selectively controlling said second LED array portions, wherein said second LED array upper portion in combination with said second lens generates a third light beam in said first direction, said second LED array cover portion generates a fourth light beam in said second direction;

further comprising the steps of:

a) generating said third light beam directed at the pedestrian at the far side of the roadway; and b) generating said fourth light beam directed at the pedestrian proximate the middle of the roadway.

18. The method as specified in claim 17 wherein said first and second light beam illuminate a symbol indicative of "walk," and said third and fourth light beam illuminate a symbol indicative of "don't walk."

19. The method specified in claim 18 wherein said method has three states, a first state generating said first and second light beam, a second state generating said second and third light beam, and a third state generating said third and forth light beam.

20. The method as specified in claim 19 wherein each said light beam has a beamwidth of about 10 degrees.

* * * * *